US007699216B2

(12) United States Patent
Smith et al.

(10) Patent No.: US 7,699,216 B2
(45) Date of Patent: Apr. 20, 2010

(54) TWO-PIECE INSULATED CUP

(75) Inventors: Stephen Alan Smith, Naperville, IL (US); Warren Giles Wiedmeyer, Trevor, WI (US); Ayberk Abayhan, Lake Bluff, IL (US); Anthony Joseph Kreml, Jr., Baltimore, MD (US); Alvin Chester Hartman, Baltimore, MD (US); Semyon Bekker, Baltimore, MD (US); Greg Neal, Pasadena, MD (US); Robert Joseph Schaefer, Nottingham, MD (US); Robert Michael Scheele, Rogersville, MO (US); Dennis Wayne Martin, Springfield, MO (US)

(73) Assignee: Solo Cup Operating Corporation, Lake Forest, IL (US)

( * ) Notice: Subject to any disclaimer, the term of this patent is extended or adjusted under 35 U.S.C. 154(b) by 1467 days.

(21) Appl. No.: 10/982,187

(22) Filed: Nov. 4, 2004

(65) Prior Publication Data

US 2005/0115975 A1 Jun. 2, 2005

Related U.S. Application Data

(60) Provisional application No. 60/525,531, filed on Nov. 26, 2003, provisional application No. 60/591,644, filed on Jul. 28, 2004.

(51) Int. Cl.
*B65D 3/22* (2006.01)
*B65D 21/04* (2006.01)

(52) U.S. Cl. ..... 229/403; 206/515; 206/519; 229/103.11

(58) Field of Classification Search ..... 229/103.11, 229/403; 206/515, 519, 520; 220/592.17, 220/592.2, 737, 738, 739
See application file for complete search history.

(56) References Cited

U.S. PATENT DOCUMENTS

| | | | |
|---|---|---|---|
| 809,812 | A | 1/1906 | Kimsey |
| 811,409 | A | 1/1906 | Kimsey |
| 1,057,426 | A | 4/1913 | Heyl |
| 1,107,956 | A | 8/1914 | Jennings |
| 1,198,596 | A | 9/1916 | Strange |

(Continued)

FOREIGN PATENT DOCUMENTS

| | | |
|---|---|---|
| EP | 0 371 918 | 6/1990 |

(Continued)

OTHER PUBLICATIONS

Huhtamaki reference regarding thermoforming, dated at least as early as Nov. 2004.

(Continued)

*Primary Examiner*—Gary E Elkins
(74) *Attorney, Agent, or Firm*—Banner & Witcoff, Ltd.

(57) ABSTRACT

The present invention generally provides an insulating vessel for beverages. The vessel has an outsert and a insert. The insert is positioned within the cavity of the outsert. In one embodiment the insert has a plurality of insulating members that are spaced from an inner surface of the outsert to define a series of air gaps between an outer surface of the insulating members and the inner surface of the outsert. In another embodiment, the insert and outsert have generally conical side walls with substantially the same taper angle so as to be in a friction lock relationship with one another.

44 Claims, 10 Drawing Sheets

U.S. PATENT DOCUMENTS

| | | | | | |
|---|---|---|---|---|---|
| 1,420,808 | A | | 6/1922 | Batdorf | |
| 1,504,245 | A | | 8/1924 | Huntley | |
| 1,518,261 | A | | 12/1924 | Holman | |
| 1,530,597 | A | | 3/1925 | Dygert | |
| 1,711,642 | A | | 5/1929 | Hulbert | |
| 1,756,243 | A | | 4/1930 | Benson | |
| 1,766,420 | A | | 6/1930 | Wessman et al. | |
| 1,771,765 | A | | 7/1930 | Benson | |
| 1,814,671 | A | | 7/1931 | DuFour | |
| 1,815,136 | A | | 7/1931 | Angell | |
| 1,818,279 | A | | 8/1931 | Smith | |
| 1,819,318 | A | | 8/1931 | Barbieri | |
| 1,833,377 | A | | 11/1931 | Smith | |
| 1,962,983 | A | | 6/1934 | Cooley | |
| 1,983,361 | A | | 12/1934 | Gazette | |
| 1,987,362 | A | | 1/1935 | Cooley | |
| 2,013,748 | A | | 9/1935 | Dunlap | |
| 2,120,901 | A | | 6/1938 | Moore | |
| 2,135,219 | A | | 11/1938 | Reifsnyder | |
| 2,140,665 | A | | 12/1938 | Carew | |
| 2,169,345 | A | | 8/1939 | Kuchler | |
| 2,215,698 | A | | 9/1940 | Harvey | |
| 2,216,331 | A | | 10/1940 | Swallow et al. | |
| 2,245,900 | A | | 6/1941 | Carew | |
| 2,252,360 | A | | 8/1941 | Barbieri | |
| 2,266,828 | A | | 12/1941 | Sykes | |
| 2,330,878 | A | | 10/1943 | Foley | |
| 2,347,236 | A | | 4/1944 | Barbieri | |
| 2,415,323 | A | | 2/1947 | Wilcox | |
| 2,416,813 | A | | 3/1947 | Barbieri | |
| 2,435,308 | A | | 2/1948 | Harvey | |
| 2,489,507 | A | | 11/1949 | Shapiro et al. | |
| 2,540,565 | A | | 2/1951 | Barbieri | |
| 2,546,621 | A | | 3/1951 | Wixon et al. | |
| 2,563,352 | A | * | 8/1951 | Morse | 206/515 |
| 2,591,578 | A | | 4/1952 | McNealy et al. | |
| 2,602,383 | A | | 7/1952 | Barbieri | |
| 2,642,784 | A | | 6/1953 | Wittkuhns et al. | |
| 2,642,785 | A | | 6/1953 | Wittkuhns et al. | |
| 2,661,889 | A | | 12/1953 | Phinney | |
| 2,783,694 | A | | 3/1957 | Wittkuhns et al. | |
| 2,802,407 | A | | 8/1957 | Majer | |
| 2,842,301 | A | | 7/1958 | Albert | |
| 2,853,222 | A | | 9/1958 | Gallagher | |
| 2,888,861 | A | | 6/1959 | Meyer-Jagenberg | |
| 2,971,304 | A | * | 2/1961 | O'Neil | 206/515 |
| 3,026,779 | A | | 3/1962 | Majer | |
| 3,028,798 | A | | 4/1962 | Allen | |
| 3,049,979 | A | | 8/1962 | Sayford, Jr. | |
| 3,063,347 | A | | 11/1962 | Cummings | |
| 3,079,027 | A | | 2/1963 | Edwards | |
| 3,123,273 | A | * | 3/1964 | Miller | 206/520 |
| 3,134,307 | A | | 5/1964 | Loeser | |
| RE25,618 | E | * | 7/1964 | Goodman | 229/403 |
| 3,144,971 | A | | 8/1964 | Wommelsdorf | |
| 3,157,096 | A | | 11/1964 | Schmidt | |
| 3,164,314 | A | | 1/1965 | Waycie | |
| 3,202,065 | A | | 8/1965 | Bolcato | |
| 3,229,595 | A | | 1/1966 | Waycie | |
| 3,288,340 | A | * | 11/1966 | Shapiro et al. | 206/519 |
| 3,289,552 | A | | 12/1966 | Corazzo | |
| 3,301,145 | A | | 1/1967 | Bodendoerfer | |
| 3,342,113 | A | | 9/1967 | Baumgartner | |
| 3,343,465 | A | | 9/1967 | Albert | |
| 3,372,830 | A | | 3/1968 | Edwards | |
| 3,414,183 | A | * | 12/1968 | Wilcox | 229/125.13 |
| 3,456,860 | A | | 7/1969 | Jannick | |
| 3,468,226 | A | | 9/1969 | England et al. | |
| 3,603,218 | A | | 9/1971 | Ludder | |
| 3,759,437 | A | | 9/1973 | Amberg | |
| 3,855,908 | A | | 12/1974 | Schmidt et al. | |
| 3,908,523 | A | | 9/1975 | Shikaya | |
| 3,927,766 | A | * | 12/1975 | Day | 206/519 |
| 4,070,953 | A | | 1/1978 | Richards et al. | |
| 4,100,842 | A | | 7/1978 | Richards et al. | |
| 4,102,454 | A | * | 7/1978 | Karevaara | 206/514 |
| 4,261,501 | A | | 4/1981 | Watkins et al. | |
| 4,398,904 | A | | 8/1983 | Fagerberg | |
| 4,409,045 | A | | 10/1983 | Busse | |
| 4,440,290 | A | | 4/1984 | Johnson et al. | |
| 4,452,596 | A | | 6/1984 | Clauss et al. | |
| 4,490,130 | A | | 12/1984 | Konzal et al. | |
| 4,680,023 | A | | 7/1987 | Varano | |
| 4,785,992 | A | | 11/1988 | Goeppner | |
| 4,993,580 | A | | 2/1991 | Smith | |
| 5,026,338 | A | | 6/1991 | Blackwelder et al. | |
| 5,092,485 | A | | 3/1992 | Lee | |
| 5,145,107 | A | | 9/1992 | Silver et al. | |
| 5,176,607 | A | | 1/1993 | Hill et al. | |
| 5,203,490 | A | | 4/1993 | Roe | |
| 5,205,473 | A | | 4/1993 | Coffin, Sr. | |
| 5,222,656 | A | | 6/1993 | Carlson | |
| 5,226,585 | A | | 7/1993 | Varano | |
| 5,324,249 | A | | 6/1994 | Konzal | |
| 5,326,019 | A | | 7/1994 | Wolff | |
| 5,337,622 | A | | 8/1994 | Konzal | |
| 5,363,982 | A | | 11/1994 | Sadlier | |
| 5,385,260 | A | | 1/1995 | Gatcomb | |
| 5,415,339 | A | | 5/1995 | Howard | |
| 5,425,497 | A | | 6/1995 | Sorensen | |
| 5,435,804 | A | | 7/1995 | Konzal | |
| 5,449,337 | A | | 9/1995 | Konzal | |
| 5,454,484 | A | | 10/1995 | Chelossi | |
| 5,524,817 | A | | 6/1996 | Meier et al. | |
| 5,529,217 | A | | 6/1996 | Siegel | |
| 5,556,364 | A | | 9/1996 | Konzal | |
| 5,569,143 | A | | 10/1996 | Konzal | |
| 5,624,367 | A | | 4/1997 | Budziszewski | |
| 5,628,453 | A | | 5/1997 | MacLaughlin | |
| 5,651,851 | A | | 7/1997 | Gatcomb | |
| 5,660,326 | A | | 8/1997 | Varano et al. | |
| 5,667,135 | A | | 9/1997 | Schaefer | |
| 5,669,553 | A | | 9/1997 | Smith | |
| 5,685,480 | A | | 11/1997 | Choi | |
| 5,697,550 | A | | 12/1997 | Varano et al. | |
| 5,713,512 | A | | 2/1998 | Barrett | |
| 5,725,916 | A | | 3/1998 | Ishii et al. | |
| 5,746,372 | A | | 5/1998 | Spence | |
| 5,752,653 | A | | 5/1998 | Razzaghi | |
| RE35,830 | E | | 6/1998 | Sadlier | |
| 5,766,709 | A | | 6/1998 | Geddes et al. | |
| 5,769,311 | A | | 6/1998 | Morita et al. | |
| 5,794,843 | A | | 8/1998 | Sanchez | |
| 5,839,653 | A | | 11/1998 | Zadravetz | |
| 5,871,430 | A | | 2/1999 | Mueller | |
| 5,964,400 | A | | 10/1999 | Varano et al. | |
| D417,845 | S | | 12/1999 | Sadlier et al. | |
| 6,085,970 | A | | 7/2000 | Sadlier | |
| 6,135,936 | A | | 10/2000 | Brown et al. | |
| 6,196,454 | B1 | | 3/2001 | Sadlier | |
| 6,257,485 | B1 | | 7/2001 | Sadlier et al. | |
| 6,264,100 | B1 | | 7/2001 | Brown et al. | |
| 6,287,247 | B1 | | 9/2001 | Dees et al. | |
| 6,378,766 | B2 | | 4/2002 | Sadlier | |
| 6,422,456 | B1 | | 7/2002 | Sadlier | |
| 6,652,435 | B1 | | 11/2003 | Sand | |
| 2003/0021921 | A1 | | 1/2003 | Debraal et al. | |
| 2006/0144915 | A1 | | 7/2006 | Sadlier | |

FOREIGN PATENT DOCUMENTS

| | | | |
|---|---|---|---|
| EP | 0371918 | A1 | 6/1990 |
| EP | 1719715 | A1 | 11/2006 |
| FR | 2 244 351 | | 4/1975 |
| FR | 2824809 | | 11/2002 |
| GB | 2253554 | A | 9/1992 |
| GB | 2261592 | A | 5/1993 |
| WO | WO2005102847 | A1 | 11/2005 |
| WO | 2006011759 | A1 | 2/2006 |

OTHER PUBLICATIONS

Photograph of Kellogg's container dated at least as early as Nov. 2001.

Photograph of PMC "Barrier Plus" container dated at least as early as Nov. 2002.

Photograph of Horizon container dated at least as early as Nov. 2004.

* cited by examiner

TWO-PIECE INSULATED CUP

CROSS-REFERENCE TO RELATED APPLICATIONS

This application is a continuation of and claims priority from provisional application Nos. 60/525,531, filed on Nov. 26, 2003, and 60/591,644, filed on Jul. 28, 2004, and hereby incorporates same by reference herein.

FEDERALLY SPONSORED RESEARCH OR DEVELOPMENT

Not Applicable.

TECHNICAL FIELD

The present invention relates generally to a disposable container, and more specifically to a thermally insulated drinking cup having an outsert and an insert.

BACKGROUND OF THE INVENTION

Various methods, containers and auxiliary devices for providing insulation to a container to keep the contents of a container warm/cold and to lessen the effects of the transfer of heat/cold to a user's hand are well known in the art. While such insulating containers and jackets according to the prior art provide a number of advantageous features, they nevertheless have certain limitations. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides an insulating vessel for beverages or other foods. In one embodiment the insulating vessel comprises an insert and a separate outsert. The insert has a sidewall and a bottom wall defining a cavity, and the insert is positioned within a cavity of the outsert. The sidewall of the insert has a plurality of alternating rib members and insulating members. The insulating members are spaced a distance from an inner surface of the outsert to define a series of air gaps between an outer surface of the insulating members and the inner surface of the outsert.

According to another embodiment, the insulating members have a generally arcuate shape comprised of a convex outer surface and a concave inner surface. The convex outer surface faces generally radially toward a center of the cavity of the container, and the concave inner surface faces generally radially toward the inner surface of the outsert.

According to another embodiment, the insulating members have a generally flat wall portion extending between the rib members and vertically about the sidewall of the insert. Thus, a plurality of air gaps are provided between the inner surface of the outsert flat wall portion of the insulating members.

According to another embodiment, the outsert is made of a paper material, and the insert is made of a plastic material. Further, in one embodiment the insert is made of a polymer foam material.

According to another embodiment, the insulating vessel comprises a paperboard outsert having a first end, a second end, and a generally conical side wall therebetween, and a separate plastic insert nested within the outsert. The insert has a first end, a generally conical side wall and a bottom wall at a second end of the outsert which closes a bottom of the insert. In one embodiment the generally conical side walls of the insert and the outsert have substantially the same taper angle so as to be in a friction lock relationship with one another.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
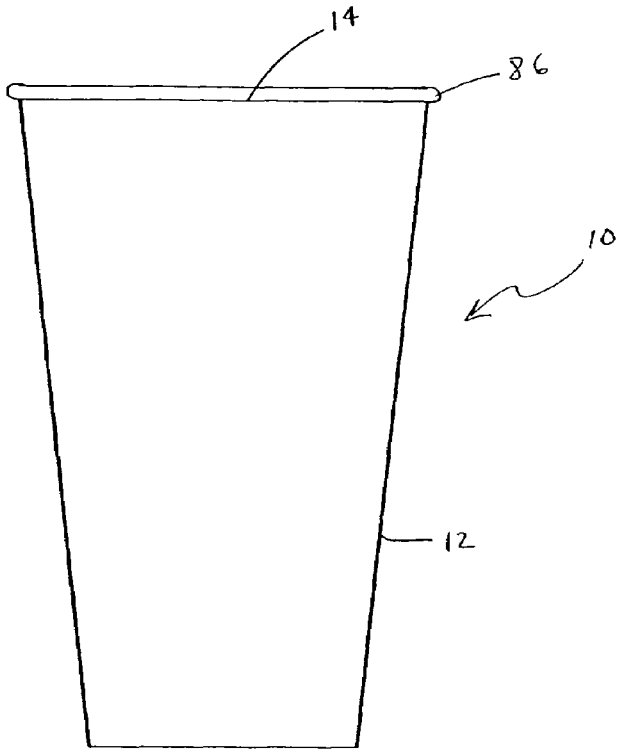
FIG. 1 is a front elevation view of one embodiment of an insulated container having an insert and an outsert.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. Particularly, the insulated container is described and shown herein as a cup for containing hot liquid, such as coffee, tea, etc. However, it should be understood that the present invention may take the form of many different types of vessels or containers used for holding heated liquids, including but not limited to beverages, soups, stews, chili, etc. Additionally, a person skilled in the art would readily recognize that the thermally insulated vessel or container of the present invention may also be used to insulate a cup holder's hand from cold contents, such as an ice-cold beverage.

Figure 2:
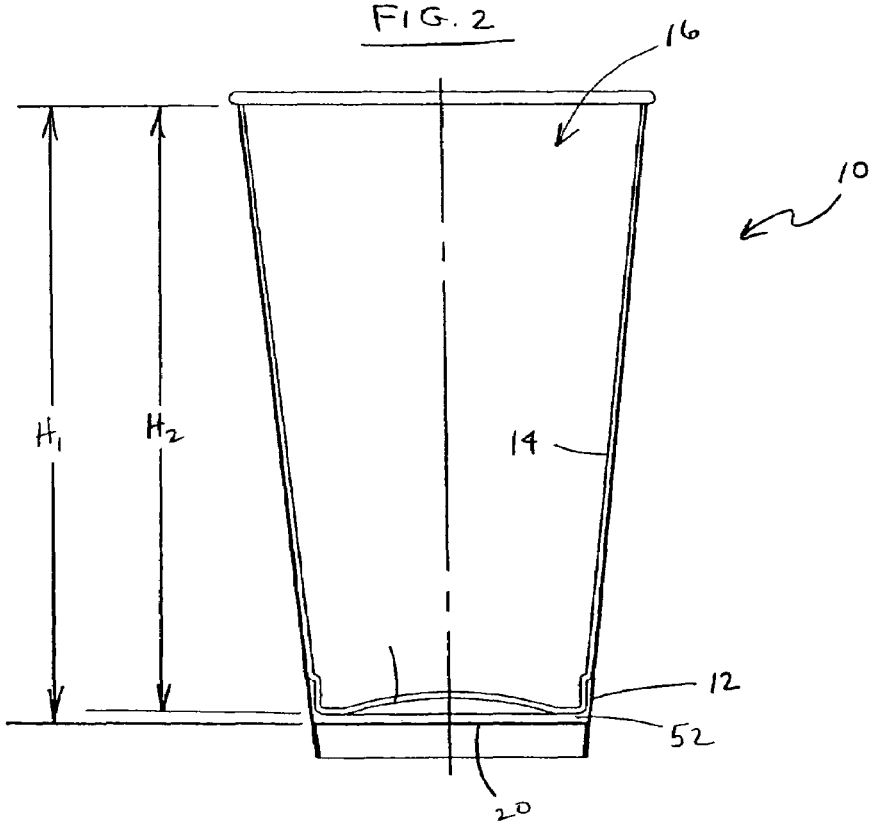
FIG. 2 is a cross-sectional view of the container of FIG. 1.

Referring now in detail to the Figures, and initially to FIGS. 1 and 2, there is shown one embodiment of an insulated vessel or container 10. The container 10 is generally comprised of an outsert 12 and an insert 14. The container 10 has a cavity 16 to hold the beverages placed therein, and to insulate them from the cup holder's hand. Thus, the container 10 provides insulation properties and gives the appearance of a single cup or food/beverage container 10.

Figure 3:
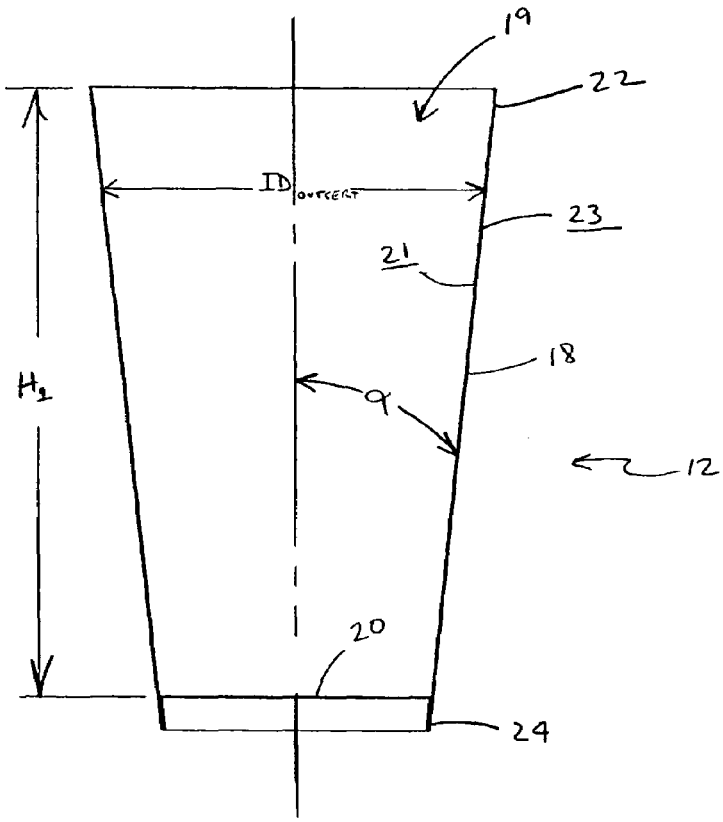
FIG. 3 is a cross-sectional view of the outsert of FIG. 1.
Figure 19A:
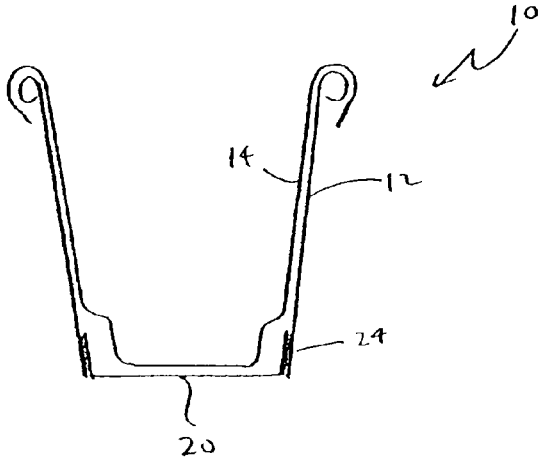
FIG. 19A is an front cross-sectional view of another embodiment of an insulated container.
Figure 19B:
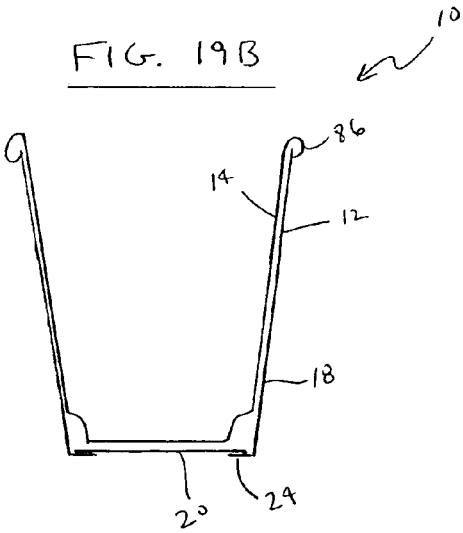
FIG. 19B is a front cross-sectional view of another embodiment of the insulated container.

The Outsert 12:

In one embodiment, as shown in FIG. 3, the outsert 12 has a sloping or frustoconically configured sidewall 18, and a bottom wall 20 defining an outsert cavity 19. Generally, the paper outsert 12 is made by forming a paperboard container having a side seam, and connecting the bottom wall 20 to the sidewall 18 of the outsert 12. The sidewall 18 has an inner surface 21 and an outer surface 23. Additionally, the sidewall 18 has a first end 22 and a second end 24. The bottom wall 20 of the outsert 12 is generally positioned a distance proximal the second end 24 of the sidewall 18. This allows the bottom wall 20 to be recessed upward from second end 24 of the outsert 12. Accordingly, in a preferred embodiment the height ($H_1$) of the sidewall 18 from the first end 22 to the bottom wall 20 is less than the distance of the sidewall 18 from the first end 22 to the second end 24. Alternatively, as shown in FIG. 19A, the bottom wall 20 may extend adjacent the second end 24 of the sidewall 18 of the outsert 12, and, as shown in FIG. 19B, the sidewall 18 of the outsert 12 is folded over and connected to a disc-shaped bottom wall 20. As a further alternative shown in FIG. 20, the outsert 12 may have no bottom wall. This style of outsert 12 would be akin to a sleeve. In such an embodiment, the insert 14 would be attached to either the inner surface 21 of the outsert 12, or to the rim 26 of the outsert 12 as detailed below. It is also understood that another alternative to the embodiment of FIG. 3 is possible. In such an embodiment the second end 24 of the sidewall 18 of the outsert 12 that is connected to the skirt portion of the bottom wall 20 may be bent radially inward and substantially parallel to the bottom wall 20 to reduce the stack height of the container 10. Accordingly, it is understood that the formation of the outsert 12, including the connection between the sidewall 18 and the bottom wall 20, if any, may be accomplished in a variety of methods without departing from the scope of the present invention.

Further, the outsert 12 may or may not have a rim 26 associated therewith. In the embodiments shown in FIGS. 1-3 and 10, the outsert 12 terminates at the first end 22 of the sidewall 18 and has no curled rim extending therefrom. In alternative embodiments, as shown in FIGS. 5-6, 11-17 and 19-20, the outsert 12 has an outwardly extending rim 26 depending from the first end 22 of the sidewall 18 of the outsert 12.

As explained above, the sidewall 18 of one embodiment of the outsert 12 is frustoconical in shape. In alternate embodiments, however, it is understood that the sidewall may have other geometric configurations, including being straight or substantially perpendicular to the bottom wall. Accordingly, the inner surface 21 of the sidewall 18 of the outsert 12 has an inner diameter ($ID_{OUTSERT}$) associated therewith. Where the sidewall 18 of the outsert 12 is frustoconically shaped or sloped in geometry, the inner diameter ($ID_{OUTSERT}$) of the outsert 12 decreases from the first end 22 of the outsert 12 to the second end 24 of the outsert 12. In a preferred embodiment, the sidewall 18 of the outsert 12 is provided at a sidewall taper angle ($\alpha$). In one example of a 20 oz. container 10, the outside sidewall taper angle ($\alpha$) of the outsert 12 is approximately 5° 55' 0" with respect to a centerline of the outsert 12.

In a preferred embodiment, the outsert 12 is made from a paper substrate. Further, in a preferred embodiment having a bottom wall 20 the outsert 12 is made of a two-piece construction. As such, the sidewall 18 is one component and the bottom wall 20 is a separate component that is joined to the sidewall 18. It is understood, however, that the outsert 12 may be made of a one-piece component. Further, it is understood that the outsert 12 may be made of materials other than paper without departing from the scope of the present invention. Specifically, the outsert 12 may be made of a plastic material, a pulp molded material, a foam material including a starch-based foam material, or other materials suitable for forming an outsert 12.

In the embodiment illustrated in FIGS. 1-3, the paper stock for the sidewall 18 of the outsert 12 is approximately 0.0113" thick normal sizing low density uncoated paper, and the paper stock for the bottom wall 20 of the outsert 12 is approximately 0.0093" thick normal sizing medium density uncoated paper. In an alternate embodiment, such as shown in FIGS. 5-20, the paper stock for the sidewall 18 of the outsert 12 is approximately 0.016" thick, and the paper stock for the bottom wall 20 of the outsert 12 is approximately 0.012". It is anticipated, however, that the stock thickness of the paper for the outsert 12, and most especially for the sidewalls 18, may be reduced without detrimentally affecting the rigidity of the overall container 10. Additionally, if desired, the paper stock may also be thicker than that identified in the embodiment above. Further, one of ordinary skill in the art would readily understand that variations in the sizing, coating, density, etc. of the stock paper may be employed without departing from the scope of the present invention. Using a paper material for the outsert 12 of the container 10 of the present invention provides several advantages: the outsert 12 can be inexpensively produced on high-speed conventional cup forming equipment; the paper can be preprinted; the printing can extend the full length or height (H) of the sidewall 18 (i.e., from the first end 22 of the sidewall 18 to the second end 24 of the sidewall 18 ); and, the stiffness and rigidity of the outsert 12 is maintained.

As explained above, if paper is utilized as the material for the outsert 12, the paper may or may not have a coating. In one such embodiment, the paper outsert 12 does not have a coating thereon. Such an outsert 12 may be formed by a cold-seal forming process at extremely high speeds on conventional cup-forming equipment. Because this type of outsert 12 is manufactured without a coating and at extremely high speeds, it is generally less expensive to manufacture. In an alternate embodiment, however, the paper material of the outsert 12 may be coated with a coating. Various coatings include wax, polymer based coatings such as a polyethylene or polypropylene based coating, coatings that are not polymer based, environmentally-friendly based coatings such as biodegradable coatings, non-oil based resins, etc. Naturally, these and other coatings may be used and still fall within the scope of the present invention. If a coating is utilized, it may be applied to one or both of the inner surface 21 and/or the outer surface 23 of the outsert 12. One purpose of using a coated paper-stock material is to provide an insulation barrier against the transfer of heat through the side wall 18 or, to a lesser extent, through the bottom wall 20 of the outsert 12. An additional purpose of the coated paper-stock material is for adhesion or bonding purposes during manufacturing of the outsert 12.

The Insert 14:

A variety of inserts 14 may be utilized with the various embodiments of the outsert 12 described above to form the overall container 10. The insert 14 generally comprises a vessel for holding the heated or cooled food/beverage or other item placed in the container 10. In a preferred embodiment, the insert 14 is a vessel that provides insulative properties. Like the outsert 12, the insert 14 has a sidewall 30 and a bottom wall 32 defining an insert cavity 33. In the finished container 10, the insert cavity 33 is the container cavity 16 of the overall container 10. Additionally, the insert 14 may be a vessel that has sealed seams, or it may be a seamless vessel.

Figure 4:
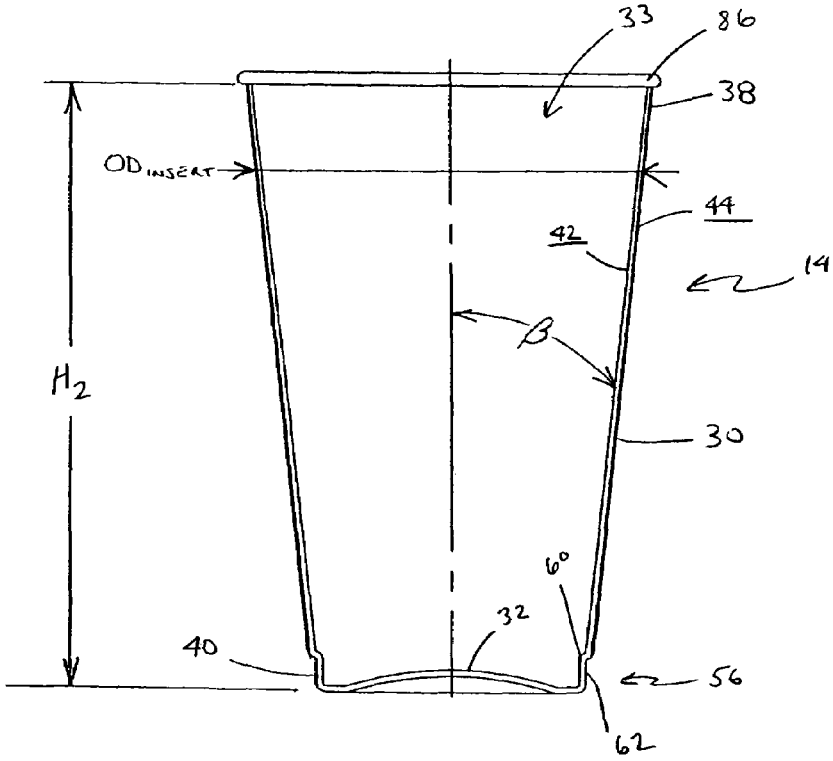
FIG. 4 is a cross-sectional view of the insert of FIG. 1.
Figure 9:
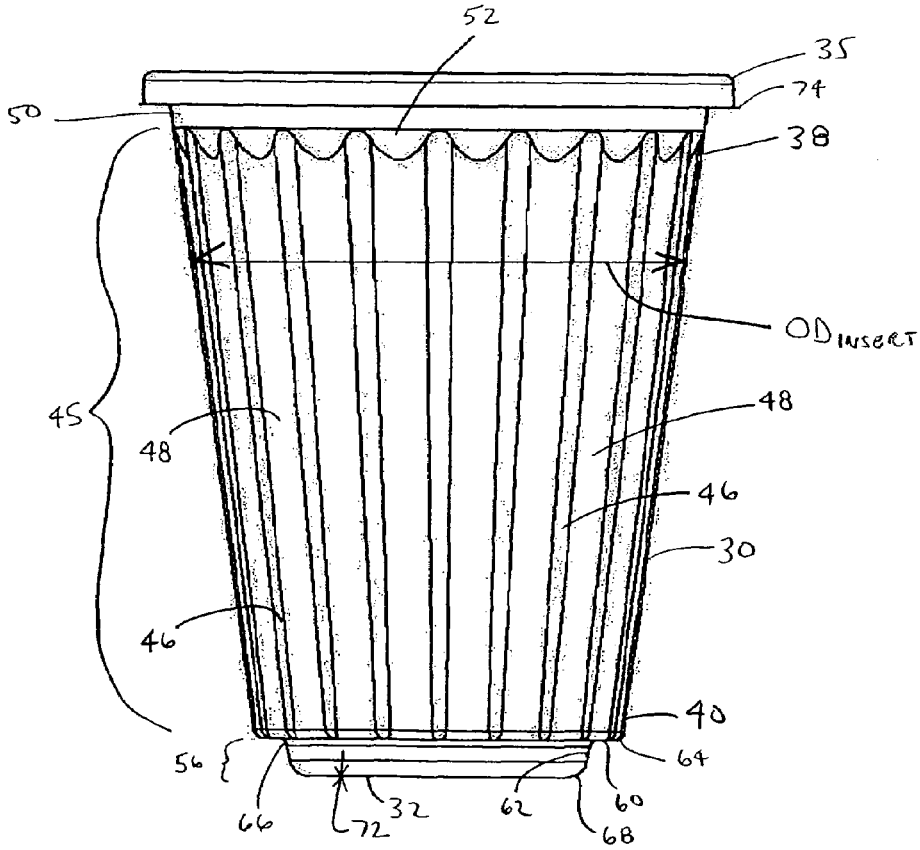
FIG. 9 is a front elevation view of the insert of FIG. 7.

Various embodiments of the insert 14 for the container 10 are shown in the Figures. Generally, the sidewall 30 of the insert 14 has a first end 38 and a second end 40, an inner surface 42, an outer surface 44 and an outside diameter ($OD_{INSERT}$). In one embodiment, such as shown in FIGS. 4 and 9, the bottom wall 32 of the insert 14 extends from the second end 40 of the insert 14. The bottom wall 32 may be substantially flat, or it may be slightly domed as shown in the FIG. 4. Additionally, the insert 14 has a height ($H_2$) from the first end 38 to the second end 40 thereof. In the embodiment shown in FIGS. 1-4, the height ($H_2$) of the insert 14 is generally less than the height ($H_1$) of the outsert 12. Alternatively, the height ($H_2$) of the insert 14 may be substantially equal to the height ($H_1$) of the outsert 12.

In the embodiment of FIG. 4, like the sidewall 18 of the outsert 12, the sidewall 30 of this embodiment of the insert 14, or at least a portion of the sidewall 30 of this embodiment of the insert 14, is also generally sloping or frustoconical in shape. In a preferred embodiment, the sidewall 30 of the insert 14 is provided at a sidewall taper angle (β). In one example of a 20 oz. container 10, the outside sidewall taper angle (β) is approximately 5° 59' 32" with respect to a centerline of the insert 14.

Additionally, in the embodiment shown in FIGS. 1-4, the sidewall taper angle (β) of the insert 14 is substantially identical to the sidewall taper angle (α) of the outsert 12. Because of manufacturing constraints, however, the sidewall taper angle (α) of the insert 14 may not be exactly identical to the sidewall taper angle (β) of the outsert 12. For example, if the insert 14 is made of a foam material, the expansion of the foam material during manufacture thereof is only controllable within certain limits. Thus, to account for variations in either the insert 14 or the outsert 12, in a preferred embodiment the sidewall taper angle (α) of the insert 14 is slightly dissimilar from the sidewall taper angle (β) of the outsert 12 (i.e., in one example α equals 5°55' 0", and β equals 5° 59' 32".

Alternatively, in the embodiment of FIGS. 7-11 the sidewall 30 of the insert 14 is not made of a substantially straight frustoconical wall. Rather, the sidewall 30 of the insert 14 has an insulation portion 45 comprised of a series of vertical ribs 46 alternating with a series of vertical arcuate insulating members 48. The ribs 46 generally provide increased rigidity to the insert 14, as well as a termination point for the air gaps 82 identified below.

The vertical arcuate insulating members 48 extend radially inward from the outside diameter ($OD_{INSERT}$) of the insert 14. Typically, in the preferred embodiment the individual radius of each arcuate member ($R_{AM}$) about a specific horizontal plane of the insert 14 is uniform, however the radius of the arcuate members ($R_{AM}$) about a specific horizontal plane may, or may not, decrease as the horizontal planes extend from the first end 38 of the insert 14 to the second end 40 of the insert 14. If, however, the sidewall 30 of the insert 14 is not frustoconical in shape, the radius of the arcuate members ($R_{AM}$) about a specific horizontal plane may be constant for each individual horizontal plane as the horizontal planes extend from the first end 38 of the insert 14 to the second end 40 of the insert 14. The preferred embodiment of the insert 14 cross-sectional geometry, however, seeks to maximize the sidewall 30 strength of the insert 14.

Vertical ribs 46 and vertical arcuate insulating members 48 are disclosed for this embodiment, however, it is understood that the geometry and positioning of the ribs and insulating members may be varied without departing from the scope of the present invention. Thus, the ribs and insulating members may be any organized or random shape, including but not limited to horizontal, sinusoidal, vertical or angular. In an alternate embodiment described below the insulating members 48 comprise flats or facets 47. Further, as discussed below, while the individual positioning of the ribs and insulating members on the insert is not critical, the positioning of these members when the insert 14 is combined with the outsert 12 is more important.

As shown in the FIG. 9, the sidewall 30 of one embodiment of the insert 14 is made of several different areas. First, a circumferential straight-wall ring portion 50 of the insert 14 is provided adjacent the first end 38 of the insert 14. Next, a transition area 52 is provided between the straight-wall ring portion 50 of the insert 14 and the insulation portion 45 of the insert 14. In this embodiment the transition area 52 provides a chamfered or beveled portion to connect to a top 54 of the arcuate insulating members 48. It is understood that in different embodiments the insert 14 may not have a circumferential straight-wall ring portion 50 and/or a transition area 52. Instead, the insulation portion 45 of the insert 14 may extend to the first end 38 of the insert 14.

A necked-down or stepped portion 56 of the insert is adjacent the bottom 32 of the insulating portion 45 of the insert 14. As is detailed more fully below, the necked-down portion 56 assists in nesting or stacking of the containers 10. If nesting or stacking of the containers 10 is not a concern, the necked-down portion 56 of the insert 14 may be eliminated. Generally, the necked-down portion 56 comprises a shoulder 60 and a smaller circumferential straight-wall ring portion 62. The smaller circumferential straight-wall ring portion 62 ends adjacent the bottom wall 32 of the insert 14. A first radius 64 joins the shoulder 60 to the sidewall 30; a second radius 66 joins the shoulder 60 to the straight-wall ring portion 62; and, a third radius 68 joins the straight-wall ring portion 62 to the bottom wall 32.

As explained above, the insert 14 has an outside diameter ($OD_{INSERT}$). In such an embodiment the outside diameter ($OD_{INSERT}$) of this insert 14 generally refers to the outside diameter ($OD_{INSERT}$) of the vertical ribs 46. As explained above, the sidewall 30 of the insert 14 is generally sloping or frustoconical in shape. Accordingly, similar to the inner diameter ($ID_{OUTSERT}$) of the inner surface 21 of the outsert 12, the outside diameter ($OD_{INSERT}$) of the insert 14 decreases from the first end 38 of the insert 14 to the second end 40 of the insert 14.

The insert 14 also has an inner diameter ($ID_{INSERT}$) that generally refers to the inside diameter ($ID_{INSERT}$) of the adjacent apexes 70 of the arcuate insulating members 48. The arcuate insulating members 48 are a portion of the sidewall 30, and thus while formed of arcuate members they nevertheless have a sloping angle to them. Accordingly, similar to the inner and outer diameters discussed above, the insert inner diameter ($ID_{INSERT}$) also decreases from the first end 38 of the insert 14 to the second end 40 of the insert 14.

Figure 21:
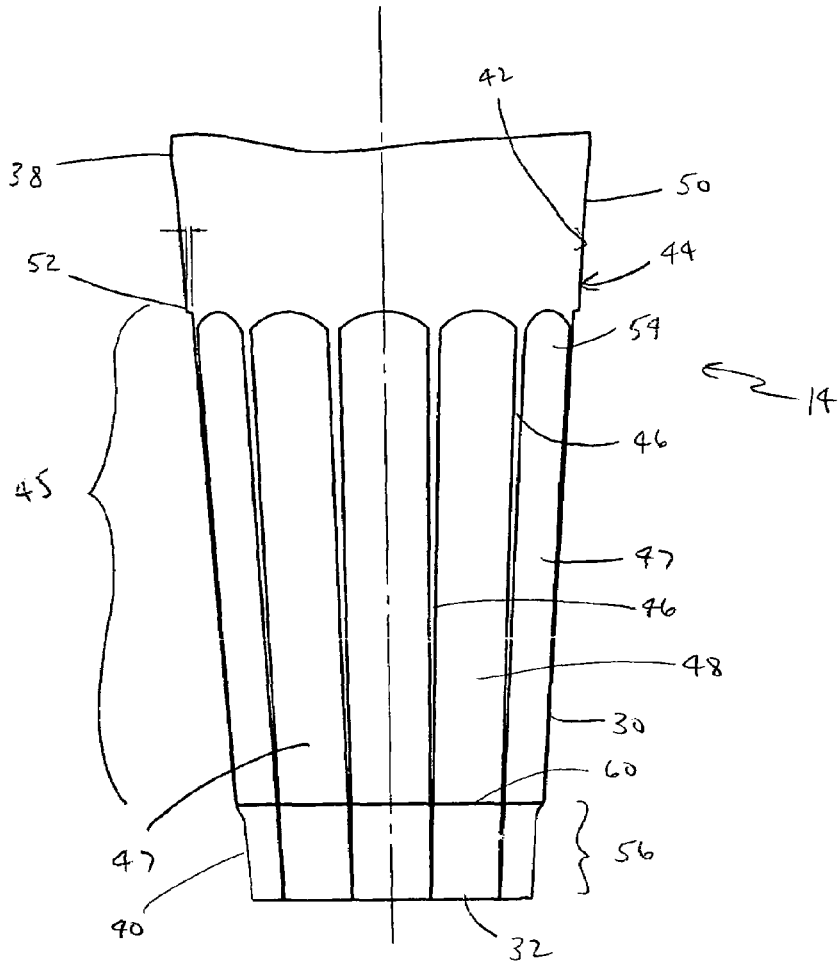
FIG. 21 is a front elevation view of an insert for a container.
Figure 22:
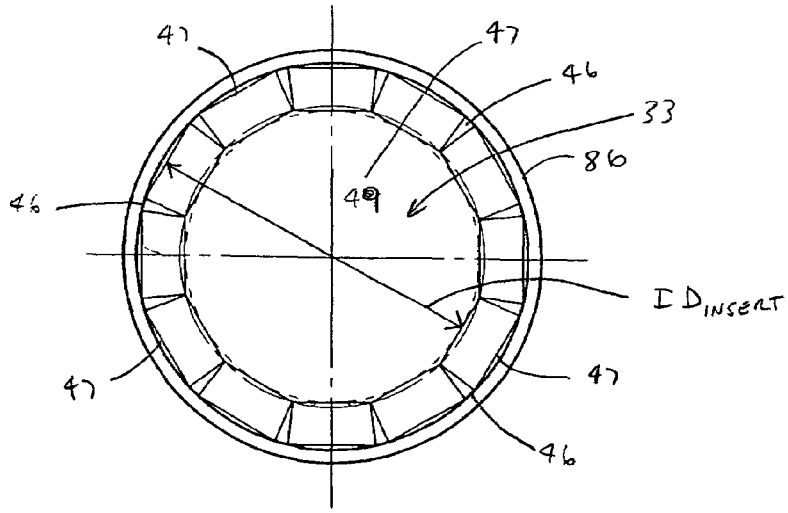
FIG. 22 is a top view of the insert of FIG. 21.
Figure 5:
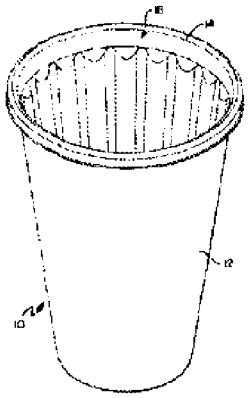
Figure 6:
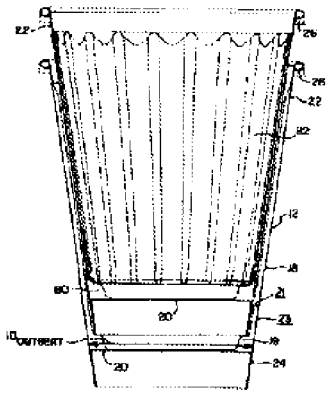
Figure 7:
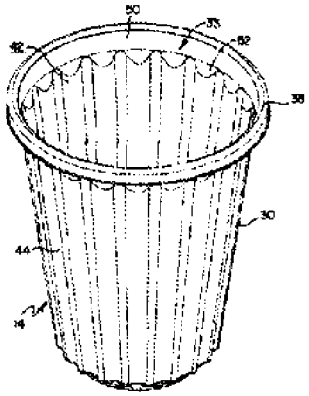
Figure 8:
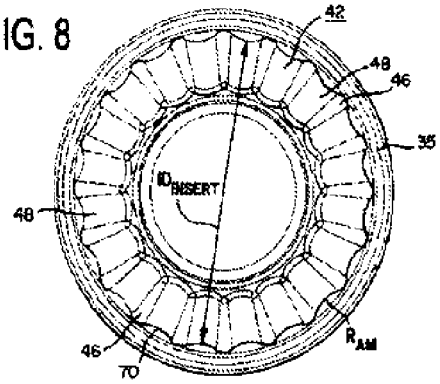
Figure 9:
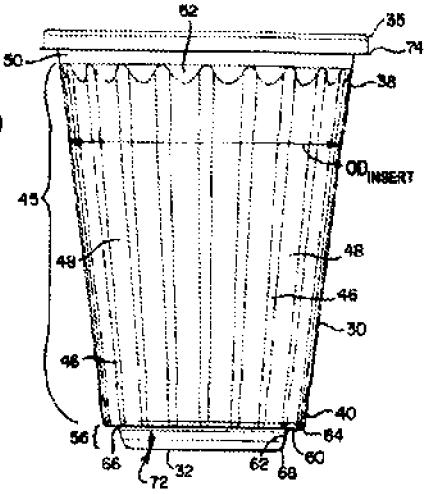
Figure 10:
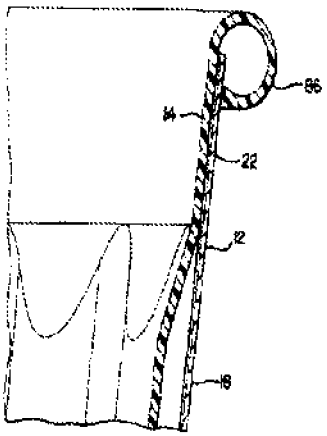
Figure 11:
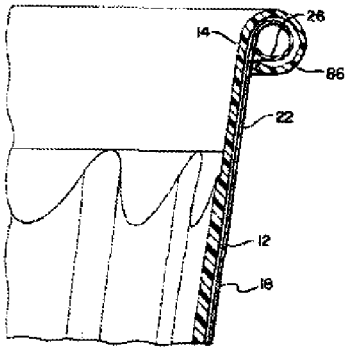
Figure 12:
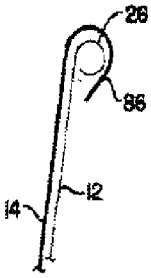
Figure 13:
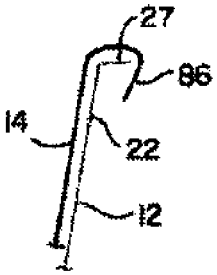
Figure 14:
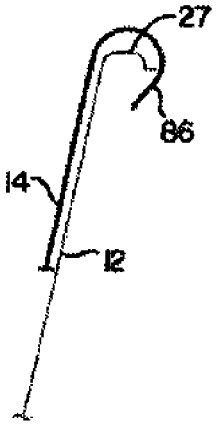
Figure 15:
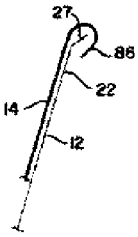
Figure 16A:
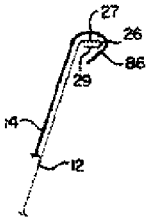
Figure 16B:
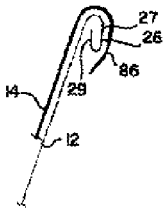
Figure 17:
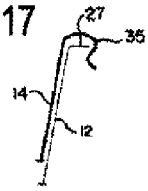
Figure 18:
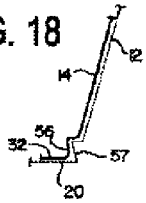
Figure 19A:
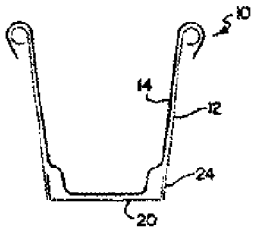
Figure 19B:
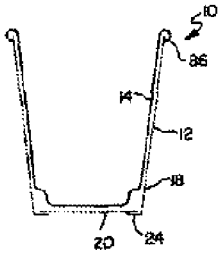
Figure 20:
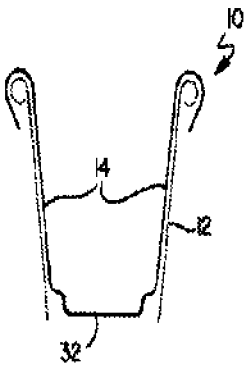
Figure 21:
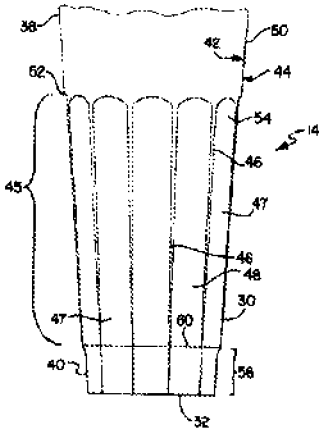
Figure 22:
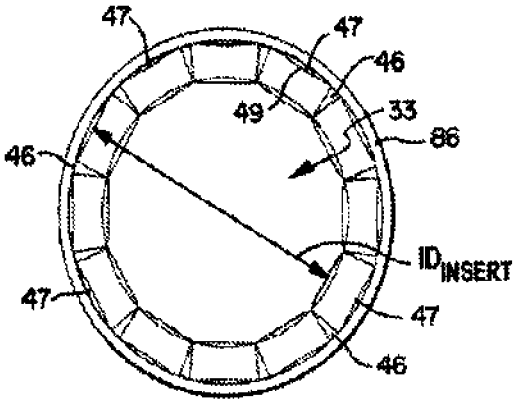

Another alternative embodiment of the insert 14 is shown in FIGS. 21 and 22. In this embodiment the sidewall 30 of the insert 14 is not made of a substantially straight frustoconical wall. Rather, like the embodiment above, the sidewall 30 of the insert 14 has an insulation portion 45 comprised of a series of flats or facets 47, instead of vertical arcuate insulating members 48. In a preferred example of this embodiment, the flats 47 are vertically aligned and are adjoining at vertical ribs 46, however, one of ordinary skill in the art would understand that they do not need to be adjoining and could have arcuate or other shaped portions therebetween. The flats 47 and ribs 46 similarly assist in providing increased rigidity to the insert 14, as well as a providing an area for the air gaps 82 identified below.

In one embodiment of the insert 14 with flats 47 on the sidewall 30 thereof, twelve flats 47 are provided. It is understood, however, that fewer or more flats 47 may be provided on the sidewall 30 of the insert 14. The flats 47 are generally flat walled members. In such an embodiment the insert 14 has an outside diameter ($OD_{INSERT}$) that is measured from the vertical ribs 46 of the insert 14. Similarly, the insert 14 has an inner diameter ($ID_{INSERT}$) that generally refers to the inside diameter of the adjacent centers 49 of the flats 47. The flat 47 style of insulating members 48 are a portion of the sidewall 30, and thus while formed of flats they nevertheless have a sloping angle to them. Accordingly, similar to the inner and outer diameters discussed above, the insert inner diameter ($ID_{INSERT}$) and outer diameter ($OD_{INSERT}$) generally decrease from the first end 38 of the insert 14 to the second end 40 of the insert 14.

Referring to FIG. 21, the sidewall 30 of this embodiment of the insert 14 is also made of several different areas. First, a circumferential straight-wall ring portion 50 of the insert 14 is provided adjacent the first end 38 of the insert 14. Next, a transition area 52 is provided between the straight-wall ring portion 50 of the insert 14 and the insulation portion 45 of the insert 14. In this embodiment the transition area 52 provides a transition to a top 54 of the flat 47 insulating members 48. Finally, a stepped or necked-down portion 56 of the sidewall 30 of the insert 14 is provided adjacent the second end 40 of the insert 14. As explained above, the necked-down portion 56 generally assists in nesting or stacking of the containers 10. If nesting or stacking of the containers 10 is not a concern, the necked-down portion 56 of the insert 14 may be eliminated. It is also understood that the stepped down portion 56 may comprise intermittent shoulders 60 or protrusions extending into the cavity of the insert 14, such as for example three equally spaced shoulders, or it may comprise a continuous ring about the interior of the sidewall 30 thereof.

Referring to the Figures, one embodiment of the insert 14 has a rim or lip 86. In a preferred embodiment of this insert 14, the rim 86 is formed as part of the insert 14, and most preferably is formed as an outwardly formed or outwardly rolled member thereof. As explained below, in a preferred embodiment of the container 10 the insert 14 has a rim 86 and the outsert 12 does not (see for example FIGS. 2 and 10). Alternate embodiments are possible, however, where the insert 14 has no rim and the outsert 12 has a rim 26, and where both the insert 14 and the outsert 12 have rims (see for example FIG. 11). In the latter embodiment where both the insert 14 and the outsert 12 have rims, the rim of the container 10 may be formed by rolling the rim of the insert 14 and the outsert 12 together to form a unified rim for the container 10, or by rolling the rim 86 of the insert 14 around the rim 26 of the insert 12.

The insert 14 may be made of various materials. In the embodiment of FIGS. 1-4 and 21-22, the insert 14 is preferably made of a thermoplastic material. Most preferable the material is a foam material comprising polystyrene, however, the material be, but is not limited to, polypropylene, polyethylene, polyester, polystyrene, polycarbonate, nylon, acetate, polyvinyl chloride, saran, other polymer blends, biodegradable materials, paper, etc. By selecting the desired plastic or non-polymer material and further selecting the appropriate properties for the selected material, the insert 14 can be formed of a material that is tailored to the product end use. In one particular embodiment, such as the insert 14 of FIGS. 1-4 and 21-22 is made of a thermoformed polystyrene foam. Thermoforming is an inexpensive forming process used to rapidly produce high volumes of insert 14. It is understood, however, that a variety of other forming methods for creating the insert, may be utilized without departing from the scope of the present invention. For example, in another embodiment of the insert 14, such as that shown in FIGS. 5-9, the insert 14 is made of a plastic material, and most preferable polypropylene, however, the material may be, but is not limited to, polyethylene, polyester, polystyrene, polycarbonate, nylon, acetate, polyvinyl chloride, saran, other polymer blends, biodegradable materials, etc. As in the example above, the preferred method of manufacture for the insert 14 of FIGS. 5-9 is via a thermoforming process which is different from the above-type of thermoforming process. In this example, the specific type of thermoforming process begins with a thin sheet or web of material. The sheet or web is heated to a temperature suitable for thermoforming the web, in the range of from about 110° C. to about 200° C. for the above-mentioned materials, and is then fed into a conventional forming machine with the aid of which the thermoforming process takes place under applied vacuum conditions. A mold cavity is used to impart a particular design into the sidewall of the insert 14 as the plastic material is drawn into the mold using vacuum pressure on one side and a positive pressure on the opposite side of the material. The processing time for a normal thermoforming operation of this type is typically between 1 and 20 seconds.

Methods of Manufacturing Various Embodiments of the Insulating Container 10:

In one embodiment, such as that shown in FIGS. 5-9, to create the container 10 an insert 14 and an outsert 12 are separately formed, and the insert 14 is placed in the outsert 12. In one example, the insert 14 is made of a thermoforming process as described above. This insert 14 generally has a wall thickness 72 associated therewith. In a preferred embodiment, the wall thickness 72 of this type of insert 14 is substantially equal about each member of the insert 14. As such, the entire sidewall 30 of the insert, including the vertical ribs 46 and the vertical arcuate insulating members 48, and the bottom wall 32 of the insert have a substantially equal thickness. With the thermoforming process described above, the wall thickness 72 is approximately 0.003" to 0.010", however different thicknesses may be used. It is understood that to attain various qualities of the container 10, the insert 14 and outsert 12 may be manufactured of different materials, thicknesses and geometry variations.

When a thermoforming process is utilized in such an embodiment, the stock material is usually provided in sheet form. During the forming process of the insert 14, a lip 35 thereof is created. In a thermoforming process the lip 35 has a flange 74. As is understood by one of ordinary skill in the art, the flange 74 is merely a remnant of the thermoforming process. Further, while the flange 74 is illustrated in the figures, it is typically trimmed off or minimized by design prior to joining the insert 14 to the outsert 12.

In this embodiment, when the insert 14 is placed in the outsert 12, the bottom wall 32 of the insert 14 generally contacts and rests on the bottom wall 20 of the outsert 12. Also, the outer surface 44 of the circumferential straight-wall ring portion 50 of the insert 14 contacts the inner surface 21 of the sidewall 18 of the outsert 12. The necked-down portion 56 (i.e., the shoulder 60 and the smaller circumferential straight-wall ring portion 62), however, generally does not contact either the bottom wall 20 or the inner surface 21 of the sidewall 18 of the outsert 12. Accordingly, due to the geometry of the necked-down portion 56, an air gap 80 is provided between the necked-down portion 56 of the insert 14 and the adjoining outsert 12.

Further, a portion of the outer surface 44 of the insert 14 generally contacts the inner surface 21 of the outsert 12, and a portion of the outer surface 44 of the insert generally does not contact the inner surface 21 of the outsert 12. More specifically, the outer surface 44 of the ribs 46 contacts the inner surface 21 of the sidewall 18 of the outsert 12, but the outer surface 44 of the arcuate insulating members 48 does not contact the inner surface 21 of the sidewall 18 of the outsert 12. Instead, a series of air gaps 82 are provided between each radially inward arcuate insulating member 48 and the inner surface 21 of the sidewall 18 of the outsert 12. The air gaps 82 generally terminate at the ribs 46 because the ribs generally contact the inner surface 21 of the sidewall 18 of the outsert 12. Further, in the preferred embodiment where the ribs 46 and the arcuate insulating members 48 are vertical, the air gaps 82 also terminate at generally the intersection of the transition area 52 and the straight-wall ring portion 50 adjacent generally the first end 38 of the insert 14. The air gaps 82 may also terminate adjacent a bottom of the arcuate insulating members 48. However, in the preferred embodiment the air in the air gaps 82 is in fluid communication with the air in the gap 80 provided between the necked-down portion 56 of the insert 14 and the adjoining outsert 12. Accordingly, in the preferred embodiment the air gaps 82 are in fluid communication.

As shown in the figures, the insulating members 48 of this embodiment have a generally arcuate shape, wherein the concave portion of the arcuate shape faces the sidewall 18 of the outsert 12. Accordingly, the convex shape faces radially toward the insert cavity 33. Such a shape is not a matter of mere design choice. Through testing it has been found that the convex inward arcuate shape of the insulating members 48 provides increased rigidity for the insert 14 of this type construction and material, such that when beverages or other items are placed in the cavity 33 of the container 10 the insulating members 48 do not collapse. If the insulating members 48 collapsed, the outer surface 44 of the insulating members 48 would come in contact with the inner surface 21 of the outsert 12, thereby at least partially defeating the thermally insulating properties of the present invention. Nevertheless, while the arcuate shape of the insulating members 48 provides the container 10 with a good insulating member, it is understood that other shapes and configurations of insulating members may be utilized without departing from the scope of the present invention. Further, for different materials, material thicknesses, and geometries, the shape of the insulating members may be modified.

As explained above, the outer surface 44 of the ribs 46 generally contacts the inner surface 21 of the sidewall 18 of the outsert 12. This may be true for any configuration of ribbing of the insert 14. Accordingly, since in the preferred embodiment both the sidewall 18 of the outsert 12 and the sidewall 30 of the insert 14 are frustoconical in shape, and since the insulating members 48 generally extend radially inward of the insert outside diameter, the inner diameter ($ID_{OUTSERT}$) associated with the inner surface 21 of the sidewall 18 of the formed outsert 12 at a specific horizontal plane is generally equal to the outside diameter ($OD_{INSERT}$) of the ribs 46. This allows the ribs 46 to contact the sidewall 18 of the outsert 12 and maintain a line of contact with the sidewall 18 to aid both the rigidity and thermal insulation properties of the insert 14. This phenomena is generally true for each horizontal plane of the container 10, and generally at least those horizontal planes between the circumferential straight-wall ring portion 50 of the insert 14 and the necked-down portion 56 of the insert 14.

In another embodiment, such as that shown in FIGS. 1-4 and 21-22, to create a container 10 the insert 14 and the outsert 12 are separately formed, and the insert 14 is placed in the outsert 12. As explained above with respect to this type of embodiment, in a preferred example this insert 14 is made of a foam material, and in a most preferred embodiment the insert 14 is made of a polystyrene foam material. In a preferred embodiment of the polystyrene foam insert 14, the wall thickness of the sidewall 30 of the insert 14 is approximately 0.026" thick, and the wall thickness of the bottom wall 32 of the insert 14 is approximately 0.042" thick. It is understood, however, that as the material of the insert 14 expands the wall thickness thereof may not be completely identical throughout.

As explained above, with the embodiment of FIGS. 1-4, the sidewall taper angles for the outsert 12 and insert 14 of this embodiment are substantially similar. Further, the inner diameter of the outsert 12 is substantially equal to the outer diameter of the insert 14. Thus, when the insert 14 is placed in the outsert 12, the outer surface 44 of the sidewall 30 of the insert 14 generally contacts the inner surface 21 of the sidewall 18 of the outsert 12. In the 20 oz. example described above, wherein the sidewall taper angle ($\alpha$) of the insert 14 is 5° 55' 0", and wherein the sidewall taper angle ($\beta$) of the outsert 12 is 5° 59' 32", there exist a possible clearance of 0.001" between the outer surface 44 of the insert 14 and the inner surface 21 of the outsert 12 at a distance of 1" from the rim 26 of the container 10. Further, in the same 20 oz. example described above, wherein the sidewall taper angle ($\alpha$) of the insert 14 is 5° 55' 0", and wherein the sidewall taper angle ($\beta$) of the outsert 12 is 5° 59' 32", there exists a possible clearance of 0.004" between the outer surface 44 of the insert 14 and the inner surface 21 of the outsert 12 at the bottom of the second end 40 of the insert 14. Nevertheless, accounting for manufacturing variances, there exists the possibility that the entire outer surface 44 of the sidewall 30 of the insert 14, generally from the bottom wall 32 of the insert 14 to the first end 38 of the insert, generally contacts the adjacent inner surface 21 of the outsert 12.

In this type of embodiment, the inner diameter ($ID_{OUTSERT}$) associated with the inner surface 21 of the sidewall 18 of the outsert 12 at a specific horizontal plane is generally equal to the outside diameter ($OD_{INSERT}$) of the insert 14. This allows the outer surface of the insert 14 to contact the sidewall 18 of the outsert 12 and maintain an area of contact with the sidewall 18 to aid both the rigidity and thermal insulation properties of the container 10. Even accepting the identified wall clearances above, this phenomena is generally true for each horizontal plane of the container 10. As such, a pressure-fit taper lock is formed between the insert 14 and the outsert 12 when the two components are fully seated together.

As explained above and shown in FIG. 2, in a preferred embodiment the distance from the first end 38 of the insert 14 to the bottom wall 32 of the insert 14, also identified as height ($H_2$), is less than the distance from the first end 22 of the outsert 12 to the bottom wall 20 of the outsert 12, also identified as height ($H_1$). Accordingly, a gap 92 is provided between the bottom wall 32 of the insert 14 and the bottom wall 20 of the outsert. In the 20 oz. example, the gap 52 is 0.063". The gap 92 provides several advantages. First, the gap 92 precludes the insert 14 from bottoming out on the outsert 12 when the two are joined, thereby allowing complete seating of the outsert 12 on the insert 14. Second, the gap 92 provides an area for air to reside during the taper lock engagement of the two components. Finally, the gap 92 provides an additional area of insulation of the container 10.

The embodiment of FIGS. 21 and 22 is substantially similar to the embodiment of FIGS. 1-4, except the insert 14 has a series of insulating members in the form of flats 47 adjacent to ribs 46. Thus, in this embodiment, like the embodiment of FIGS. 5-9, a portion of the outer surface 44 of the insert 14 generally contacts the inner surface 21 of the outsert 12, and a portion of the outer surface 44 of the insert generally does not contact the inner surface 21 of the outsert 12. More specifically, the outer surface 44 of the ribs 46 or the area adjoining the flats 47 contacts the inner surface 21 of the sidewall 18 of the outsert 12, but the outer surface 44 of the insulating members 48 in the form of flats 47 does not contact the inner surface 21 of the sidewall 18 of the outsert 12. Instead, a series of air gaps 82 are provided between each flat 47 and the inner surface 21 of the sidewall 18 of the outsert 12. The air gaps 82 generally terminate at the ribs 46 because the ribs generally contact the inner surface 21 of the sidewall 18 of the outsert 12. Further, in the preferred embodiment where the ribs 46 and the flat insulating members 47 are vertical, the air gaps 82 also terminate at generally the intersection of the transition area 52 and the straight-wall ring portion 50 adjacent generally the first end 38 of the insert 14. The air gaps 82 may also terminate adjacent a bottom of the flats 47. However, in the preferred embodiment the air in the air gaps 82 is in fluid communication with the air in the gap 80 provided between the necked-down portion 56 of the insert 14 and the adjoining outsert 12. Accordingly, in the preferred embodiment the air gaps 82 are in fluid communication.

Figure 10:
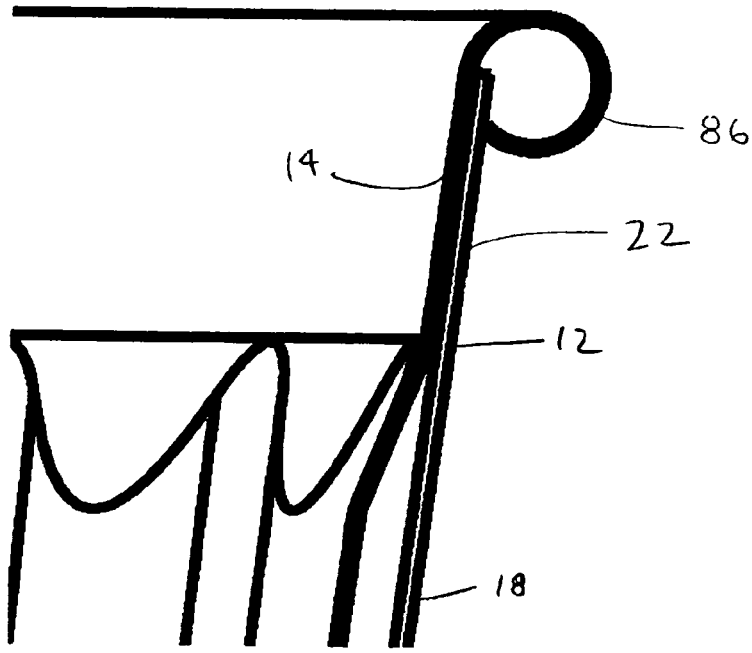
FIG. 10 is a partial cross-sectional view of one embodiment of the rim region of the container.

A variety of methods may be utilized to fixedly connect the insert 14 to the outsert 12, and it is understood that the methods disclosed herein are not exhaustive. As shown in FIG. 10, one assembly method that is utilized is referred to as a pressure fit method. In the pressure fit method of FIG. 10, the insert 14 having the rolled rim 86 is inserted into the cavity 19 of the outsert 12. In this embodiment the outsert 12 of this forming process has no rim. Instead, the outsert 12 terminates at the first end 22 of the sidewall 18 thereof. The termination at the first end 22 of the outsert 12 is fit under the rolled rim 86 of the insert 14 to lock the outsert 12 to the insert 14.

An alternate embodiment of the pressure fit method is shown in FIG. 2. In this embodiment, when the outsert 12 is fully seated on the insert 14 of the container 10, the first end 22 of the outsert 12 is substantially adjacent the rim 86 of the insert 14. Alternatively and/or additionally, an adhesive may be utilized to join the outsert 12 to the insert 14. One acceptable adhesive includes a formulated polyvinyl resin emulsion adhesive. This adhesive has a viscosity of 1,800 to 2,500 centipoises at room temperature. It is understood, however, that depending on the materials of the insert 14 and the outsert 12, a variety of adhesives may be utilized under the scope of the present invention. When an adhesive is utilized, it is typically provided to an area adjacent the first end of the outsert 12 prior to joining the outsert 12 to the insert 14, however, it is understood that the adhesive may be provided in alternate areas of the insert 14 and/or outsert 12 to connect the two components.

Figure 11:
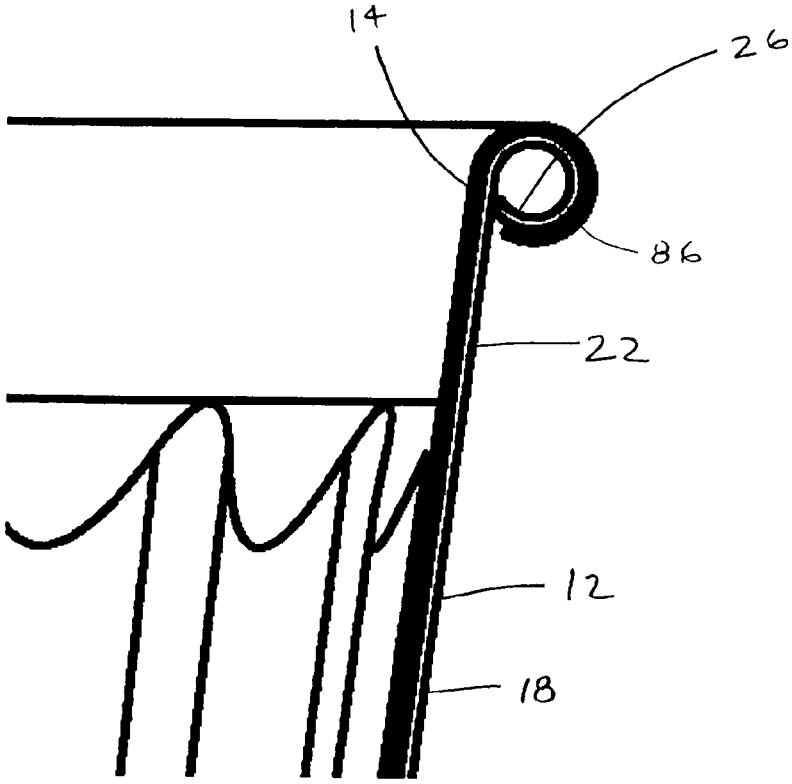
FIG. 11 is a partial cross-sectional view of another embodiment of the rim region of the container.

Another method, referred to as a rim lock method, is illustrated in FIG. 11. In the rim lock method of FIG. 11, the insert 14 is inserted into the cavity 19 of the outsert 12. In this method, however, the outsert 12 has an outwardly turned rim 26. The lip 35 of the insert 14 generally fits over the rim 26 of the outsert 12. A heated forming mandrel, or other forming means, is then used to crimp or roll the lip 35 of the insert 14 around the rim 26 of the outsert 12 to lock the lip 35 of the insert 14 to the outsert 12. After the lip 35 is rolled it forms a rolled rim 86. When the outsert 12 is made of a paper material the outsert 12 generally has an area at the rim where one layer of the rim overlaps another layer of the rim, thereby creating a possible area for leakage. This leakage or trickle, however, is substantially reduced or eliminated with the addition of the insert 14 having a uniform rim 86 overlaying the rim 26 of the outsert 12.

Figure 12:
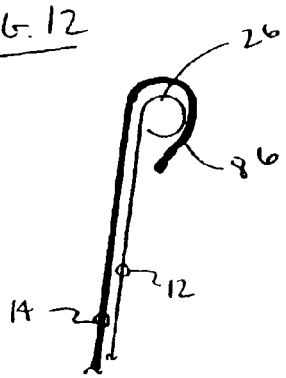
FIG. 12 is a partial cross-sectional view of another embodiment of the rim region of the container.
Figure 13:
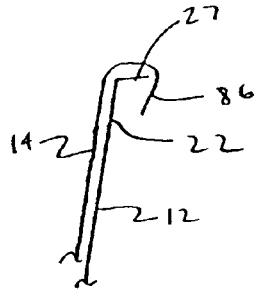
FIG. 13 is a partial cross-sectional view of another embodiment of the rim region of the container.

FIG. 12 discloses an alternate method of the rim lock method of FIG. 11. In the embodiment of FIG. 12, the lip 35 of the insert 14 is crimped around the rim 26 of the outsert 12 enough to provide a lock such that the formed rim 86 of the insert 14 will be connected to the outsert 12. However, in this method, as opposed to the method shown in FIG. 7, the rim 86 is not locked entirely around the rim 26 of the outsert 12. A similar engagement mechanism is shown in the embodiment of FIG. 13. In this embodiment, however, the outsert 12 does not have a rolled rim 26. Rather, a flange 27 extends radially away from the first end 22 of the outsert 12. Thus, in this embodiment the flange 27 operates structurally and functionally as a rim for the outsert 12. The lip 35 of the insert 14 is crimped around the flange 27 of the outsert 12 to provide a lock such that the rim 86 of the insert 14 will be connected to the outsert 12, and the flange 27 will not slip out from its connection with the crimped rim 86. In this embodiment the outsert 12 is typically made of a plastic material to provide the flange 27 with enough rigidity to maintain its engagement with the lip 35 of the insert 14. It is understood, however, that this embodiment may also be made of a paper material under appropriate manufacturing conditions understood by those having ordinary skill in this art. A first alternate embodiment to that shown in FIG. 13 is disclosed in FIG. 14. The embodiment of FIG. 14 operates and is manufactured in much the same way as the embodiment of FIG. 13.

Figure 15:
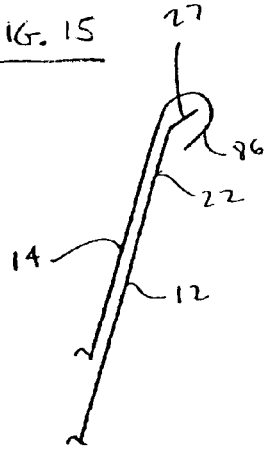
FIG. 15 is a partial cross-sectional view of another embodiment of the rim region of the container.
Figure 16A:
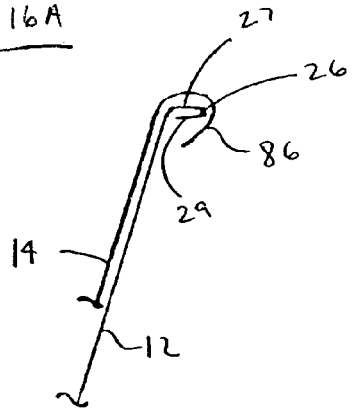
FIG. 16A is a partial cross-sectional view of another embodiment of the rim region of the container.
Figure 16B:
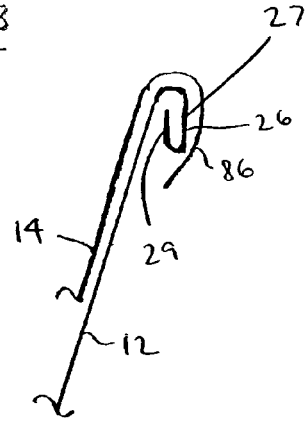
FIG. 16B is a partial cross-sectional view of another embodiment of the rim region of the container.

Additional alternate embodiments to that shown in FIG. 13 are disclosed in FIGS. 15-16B. First, in FIG. 15, the flange 27 of the outsert 12 disclosed in this embodiment has less of an angle than the flange of the embodiment disclosed in FIG. 13. Further, the flange 27 of the outsert 12 of the embodiment disclosed in FIG. 15 extends transversely from the first end 22 of the outsert 12. When the angle of the flange 27 with respect to the first end 22 of the outsert is less than 90°, the outsert 12 can more easily be made of a substrate that is not a plastic, such as a paper substrate. Notwithstanding the less severe angle of the flange 27 in this embodiment, the lip 35 of the insert 14 is still crimped around the flange 27 to provide a lock between the formed rim 86 of the insert 14 and the outsert 12. In the embodiment illustrated in FIG. 16A, which is typically made of a paper substrate, the flange 27 of the outsert 12 has a folded over portion 29. When the outsert 12 is made of a paper, folding over a portion of the flange 27 to create the rim 26 assists in strengthening the rigidity of the rim 26 of the outsert 12. Another embodiment of the vessel 10 is disclosed in FIG. 16B. In this embodiment the rim 26, formed of the flange 27 and the folded over portion 29 of the flange, is further bent downward.

Figure 17:
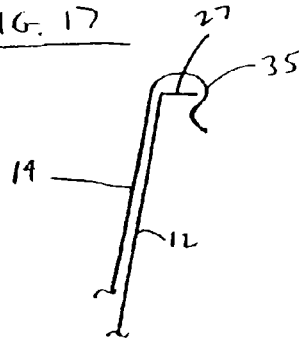
FIG. 17 is a partial cross-sectional view of another embodiment of the rim region of the container.

The embodiment of the vessel 10 disclosed in FIG. 17 is similar to the embodiment disclosed in FIG. 13, however, the lip 35 of the insert 14 is not crimped around either the flange 27 or an outwardly turned rim 26 of the outsert 12. Rather, the lip 35 of the insert 14 forms a resilient releasable locking mechanism which can be engaged and disengaged in a snap-fit arrangement to connect the insert 14 to the outsert 12.

Figure 18:
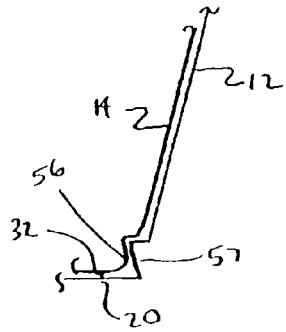
FIG. 18 is a partial cross-sectional view of another embodiment of the bottom wall of the container.

Yet another embodiment is disclosed in FIG. 18. In this embodiment, the insert 14 is connected to the outsert 12 in a snap-fit arrangement adjacent the connection of the sidewalls to the bottom walls, respectively. In the embodiment shown, the insert 14 has a necked-down feature 56, and the outsert 12 also has a necked-down feature 57 for stacking purposes. Accordingly, the neck-down feature 56 of the insert 14 engages the necked-down feature 57 of the outsert 12 to lock the insert 14 to the outsert 12.

In a preferred embodiment, while the formed rim 86 of the insert 14 is connected to either the rim 26 of the outsert 12, in the case of the embodiments shown in FIGS. 11-17, or to the first end 22 of the sidewall 18 of the outsert 12, in the case of the embodiment shown in FIGS. 2 and 10, the remaining portion of the insert 14 is generally not fixedly attached to the outsert 12. As such, the remaining portion of the insert 14, such as the ribs 46 and insulating members 48 in one embodiment, are free to float within the cavity 19 of the outsert 12. Similarly, the bottom wall 32 of the insert 14 merely rests on the bottom wall 20 of the outsert 12, or is spaced a distance from the bottom wall 20 of the outsert 12. In alternate embodiments, however, a portion of the sidewall 30 of the insert and/or the bottom wall 32 of the insert 14 is fixedly connected to the inner surface of the outsert 12.

It has been found that the container 10 manufactured in accordance with the one of the examples described above (i.e., that shown in FIGS. 1-4 and having a paper outsert 12 and a polystyrene foam insert 14), provides a substantial improvement for reducing the thermal transfer of heat to the outsert 12 of the container 10. As shown in the TABLE 1 below, this embodiment provides a reduction in the sidewall temperature of the container 10 over all other tested cups, as well as providing the least amount of temperature change in surface temperature, meaning that the temperature of the liquid in the cup was maintaining a fairly constant temperature. Thus, the container 10 provides an improvement over the prior art cups. Specifically, a test was performed on a variety of 20 oz. cups. First, boiling water having a temperature of about 190° F. was placed in each cup and the cup was capped. A thermocouple was positioned on the outside sidewall of the cup at ½ of the cup height. Sidewall temperatures were taken by the thermocouple at 7 intervals (30 seconds, 1 minute, 2 minute, 3 minute, 4 minute, 5 minute and 10 minutes). The data is provided in TABLE 1 below.

TABLE 1

| | 30 Sec. | 1 Min. | 2 Min. | 3 Min. | 4 Min. | 5 Min. | 10 Min. |
|---|---|---|---|---|---|---|---|
| Single Wall Paper Cup | 168° F. | 168° F. | 167° F. | 166° F. | 163° F. | 162° F. | 154° F. |
| Foamed Polystyrene Trophy Cup | 152° F. | 154° F. | 155° F. | 155° F. | 153° F. | 152° F. | 146° F. |
| Paper Outsert and Foamed Polystyrene Insert | 143° F. | 149° F. | 148° F. | 148° F. | 147° F. | 145° F. | 141° F. |

In another example of an embodiment of the container 10 described above (i.e., that shown in FIGS. 5-9 and having a paper outsert 12 and thermoformed polypropylene insert 14 having a plurality of arcuate insulating members 48) also provides a substantial improvement for reducing the thermal transfer of heat to the outsert 12 of the container 10. As shown in the TABLE 2 below, this container 10 provides a 22% reduction in the sidewall temperature of the container 10 over a non-insulated cup. Thus, in this embodiment the container 10 also provides an improvement over the prior art cups. Specifically, a test was performed on a variety of 16 oz. cups. First, boiling water having a temperature of about 212° F. (100° C.) was placed in each cup and the cup was capped. A thermometer was inserted through a hole in the cap and extended into the water to a distance of ½ of the cup height. Additionally, a thermocouple was positioned on the outside sidewall of the cup at ½ of the cup height. Sidewall temperatures were taken by the thermocouple after the water had cooled to about 190° F. (87.8° C.). Five samples were tested for each cup type and the average is provided in TABLE 2 below.

TABLE 2

| Cup Design | Sidewall Temperature (° F.) |
|---|---|
| Single Paper Cup | 170.0 |
| Double Paper Cup | 161.5 |
| Sleeve on Cup | 149.9 |
| Container 10 (paper outsert 12 and polypropylene insert 14) | 139.8 |
| Polystyrene Bead Foam Cup | 131.1 |

Accordingly, the vessel 10 of the present invention provides a simple and inexpensive means for improving the thermal insulative properties of beverage containers. Specifically, the present invention provides a vessel 10 which minimizes heat transfer to the outsert 12, has a low cost, is easy to manufacture and provides superior performance. As such, the present invention overcomes the deficiencies seen in the prior art.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. An insulating vessel for beverages, the container comprising:

an outsert having a sidewall defining a cavity of the outsert, the sidewall having an inner surface, a first end adjacent an opening of the cavity and a second end opposing the first end; and, a separate insert positioned within the cavity of the outsert, the insert having a sidewall comprised of a plurality of alternating rib members and insulating members, and a bottom wall extending adjacent a second end of the insert sidewall, wherein at least a portion of the alternating rib members contact the inner surface of the outsert, and wherein the insulating members are spaced a distance from the inner surface of the outsert to define a series of air gaps between an outer surface of the insulating members and the inner surface of the outsert, wherein the insulating members have a generally arcuate shape comprised of a convex outer surface and a concave inner surface, the convex outer surface facing generally radially toward a center of the cavity of the container, and the concave inner surface facing generally radially toward the inner surface of the outsert, and wherein a radius of the arcuate members decreases from the first end of the insert to the second end of the insert.

2. The insulating vessel of claim 1, further comprising a rim at a first end of the insert, the rim engaging a portion of the first end of the outsert.

3. The insulating vessel of claim 1, wherein the insulating members comprise generally vertical facets extending between the rib members.

4. The insulating vessel of claim 1, wherein the inner surface of the sidewall of the outsert has an inner diameter, wherein the rib members have an outer surface that has an outside diameter, and wherein the inner diameter of the container sidewall is generally equal to the outside diameter of the rib members at a plurality of horizontal planes.

5. The insulating vessel of claim 1, wherein the rib members maintain separate lines of contact with the inner surface of the sidewall of the outsert.

6. The insulating vessel of claim 1, wherein the rib members and the insulating members extend vertically about the sidewall of the insert.

7. The insulating vessel of claim 2, wherein the rim of the insert is connected around a rim of the outsert.

8. The insulating vessel of claim 2, wherein the first end of the outsert is fit under the rim of the insert.

9. The insulating vessel of claim 2, wherein the first end of the outsert is connected to the insert at the first end of the insert.

10. The insulating vessel of claim 1, wherein the outsert is made of a paper material.

11. The insulating vessel of claim 1, wherein the insert is made of a thermoformed plastic.

12. The insulating vessel of claim 1, wherein the insert is made of a polymer foam material.

13. The insulating vessel of claim 1, wherein the insert has a straight-wall portion at a first end of the insert, and a transition area between the straight-wall portion and the insulating members to connect a top of the insulating members to the straight-wall portion.

14. The insulating vessel of claim 1, wherein the insert has a necked-down portion adjacent the bottom wall of the insert to provide for stacking of the containers.

15. The insulating vessel of claim 1, wherein the outsert has a bottom wall that is recessed a distance from the second end of the outsert.

16. The insulating vessel of claim 1, wherein the bottom wall of the insert is spaced a distance from the bottom wall of the outsert.

17. The insulating vessel of claim 1, wherein the air gaps adjacent the insulating members are in fluid communication with a circumferential air gap adjacent the bottom wall of the insert.

18. The insulating vessel of claim 1, wherein when a cavity of the insert is filled with a liquid having a temperature of about 212° F. and the liquid is allowed to cool to about 190° F. within the liquid receptacle, the temperature of the outer surface of the outsert is no greater than about 140° F.

19. The insulating vessel of claim 1, wherein a portion of the sidewall of insert is not fixedly connected to the outsert.

20. The insulating vessel of claim 1, wherein a portion of the inner surface of the outsert is fixedly connected to the inner surface of the insert with an adhesive.

21. A two-piece container comprising:

a paperboard outsert having a first end, a second end, and a generally conical side wall therebetween, the outsert having a height between the first end and the second end thereof;

a separate plastic insert nested within the outsert, the insert having a first end, a generally conical side wall and a bottom wall at a second end of the outsert which closes a bottom of the insert, the insert further having a height between the first end and the second end thereof, wherein the generally conical side walls of the insert and the outsert have substantially the same taper angle so as to be in a friction lock relationship with one another.

22. The two-piece container of claim 21, wherein the height of the insert is shorter than the height of the outsert.

23. The two-piece container of claim 21, wherein the outsert has a bottom wall which closes a bottom of the outsert.

24. The two-piece container of claim 21, wherein the insert has a rim at the open top end of the side wall thereof, and wherein the outsert has no rim at the first end thereof.

25. The two-piece container of claim 24, wherein the first end of the sidewall of the outsert is tucked under the rim of the insert.

26. The two-piece container of claim 21, wherein said paperboard of said outsert is uncoated.

27. The two-piece container of claim 21, further comprising an adhesive connecting the insert to the outsert.

28. A two-piece container comprising:

a paperboard outsert and a separate plastic insert nested within said outsert, wherein each of said insert and outsert includes a generally conical side wall having an open top end, and a bottom wall which closes a bottom end thereof, wherein said generally conical side walls of said insert and outsert have substantially the same taper angle so as to be in a friction lock relationship with one another.

29. The two-piece container of claim 28, wherein said insert is made of a thermoformed polystyrene.

30. The two-piece container of claim 29, wherein said polystyrene is made of a thermoplastic foam.

31. A two-piece container comprising:

a paperboard outsert and a thermoformed plastic insert nested within said outsert, wherein each of said insert and outsert includes a generally conical side wall having an open top end, and a bottom wall which closes a bottom end thereof, and wherein said insert has a shorter height between said top end and said bottom wall thereof as compared to a height of said outsert between said top end and said bottom wall thereof.

32. The two-piece container of claim 31, wherein said generally conical side walls of said insert and outsert have substantially the same taper angle so as to be in a friction lock relationship with one another.

33. The two-piece container of claim 31, wherein the outsert is adhesively connected to the insert.

34. A two-piece container comprising:

a paperboard outsert having a sidewall defining an open top end and a bottom wall proximate a bottom end of the sidewall that closes the bottom end, the sidewall defining a height between the top end and the bottom end thereof; and a separate paperboard insert having a sidewall defining an open top end and a bottom wall proximate a bottom end of the sidewall that closes the bottom end, the sidewall defining a height between the top end and the bottom end thereof, wherein the insert is nested within the outsert such that a space is defined between the bottom wall of the insert and the bottom wall of the outsert, and wherein the outsert is adhesively connected to the insert.

35. The two-piece container of claim 34, wherein the sidewall of the outsert is generally conical and has a taper angle, and the sidewall of the insert is generally conical and has a taper angle substantially the same as the taper angle of the sidewall of the outsert.

36. The two-piece container of claim 34, wherein the bottom wall of the outsert is recessed a distance from the bottom end of the sidewall of the outsert.

37. The two-piece container of claim 34, wherein the insert has a rim at the open top end of the sidewall thereof, and the outsert has no rim at the open top end of the sidewall thereof.

38. The two-piece container of claim 37, wherein the outsert has a straight edge at the open top end of the sidewall thereof.

39. The two-piece container of claim 38, wherein the straight edge of the outsert is proximate the rim of the insert.

40. The two-piece container of claim 38, wherein the straight edge of the outsert is fit under the rim of the insert.

41. The two-piece container of claim 34, wherein the height of the insert is shorter than the height of the outsert.

42. The two-piece container of claim 34, wherein the sidewall of the outsert is substantially flat.

43. The two-piece container of claim 34, wherein a portion of the sidewall of the outsert is adhesively connected to a portion of the sidewall of the insert.

44. The two-piece container of claim 34, wherein the bottom wall of the insert does not contact the bottom wall of the outsert.

* * * * *

UNITED STATES PATENT AND TRADEMARK OFFICE

CERTIFICATE OF CORRECTION

PATENT NO. : 7,699,216 B2
APPLICATION NO. : 10/982187
DATED : April 20, 2010
INVENTOR(S) : Stephen A. Smith et al.

It is certified that error appears in the above-identified patent and that said Letters Patent is hereby corrected as shown below:

Delete Title Page containing an illustrative figure and substitute the attached title page therefor Delete Drawing Sheet 1 of 10 and substitute the attached

FIG. 1

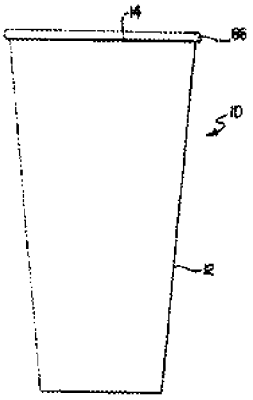

FIG. 2

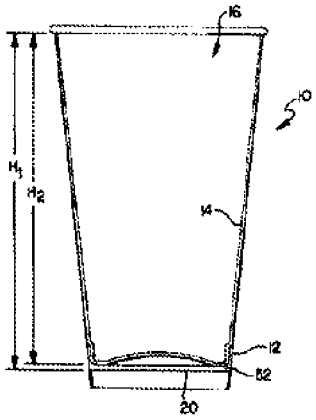

Delete Figs 3 and 4 substitute Figs 3 and 4 below therefor

FIG. 3

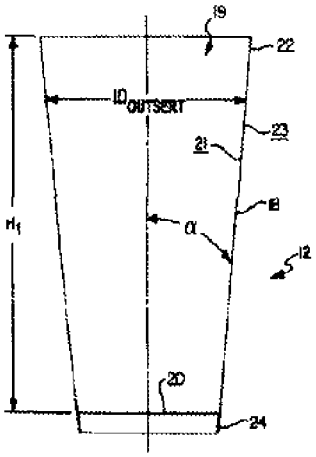

FIG. 4

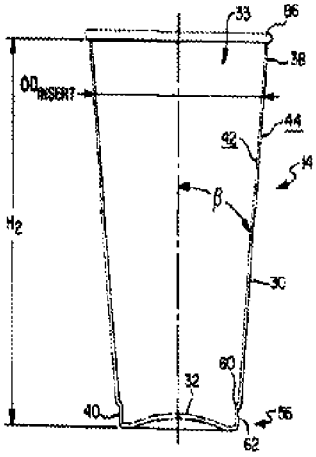

Signed and Sealed this
Fifteenth Day of February, 2011

David J. Kappos
*Director of the United States Patent and Trademark Office*

Figure 5:
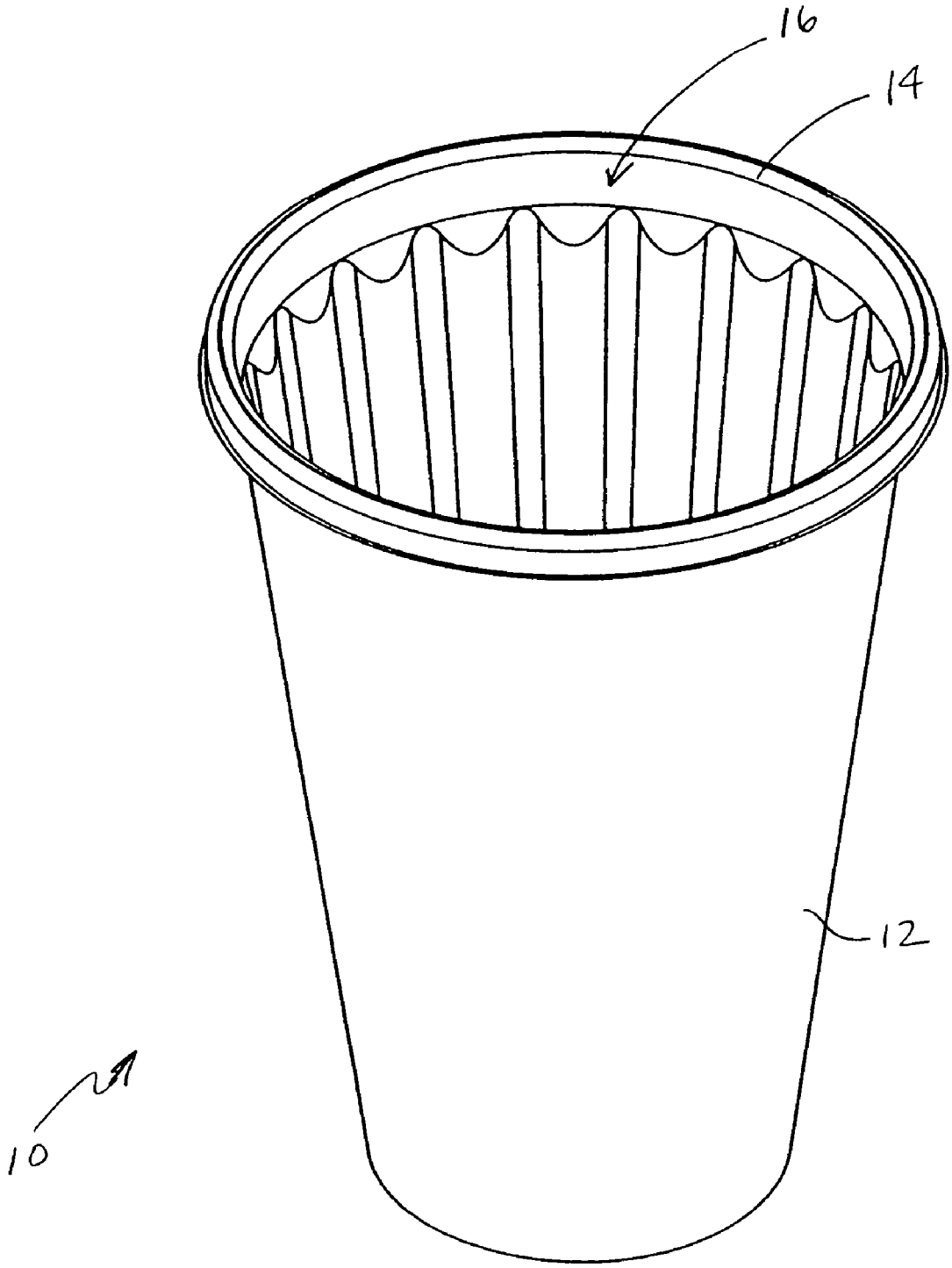
FIG. 5 is a perspective view of another embodiment of an insulated container having an outsert and an insert.
Figure 6:
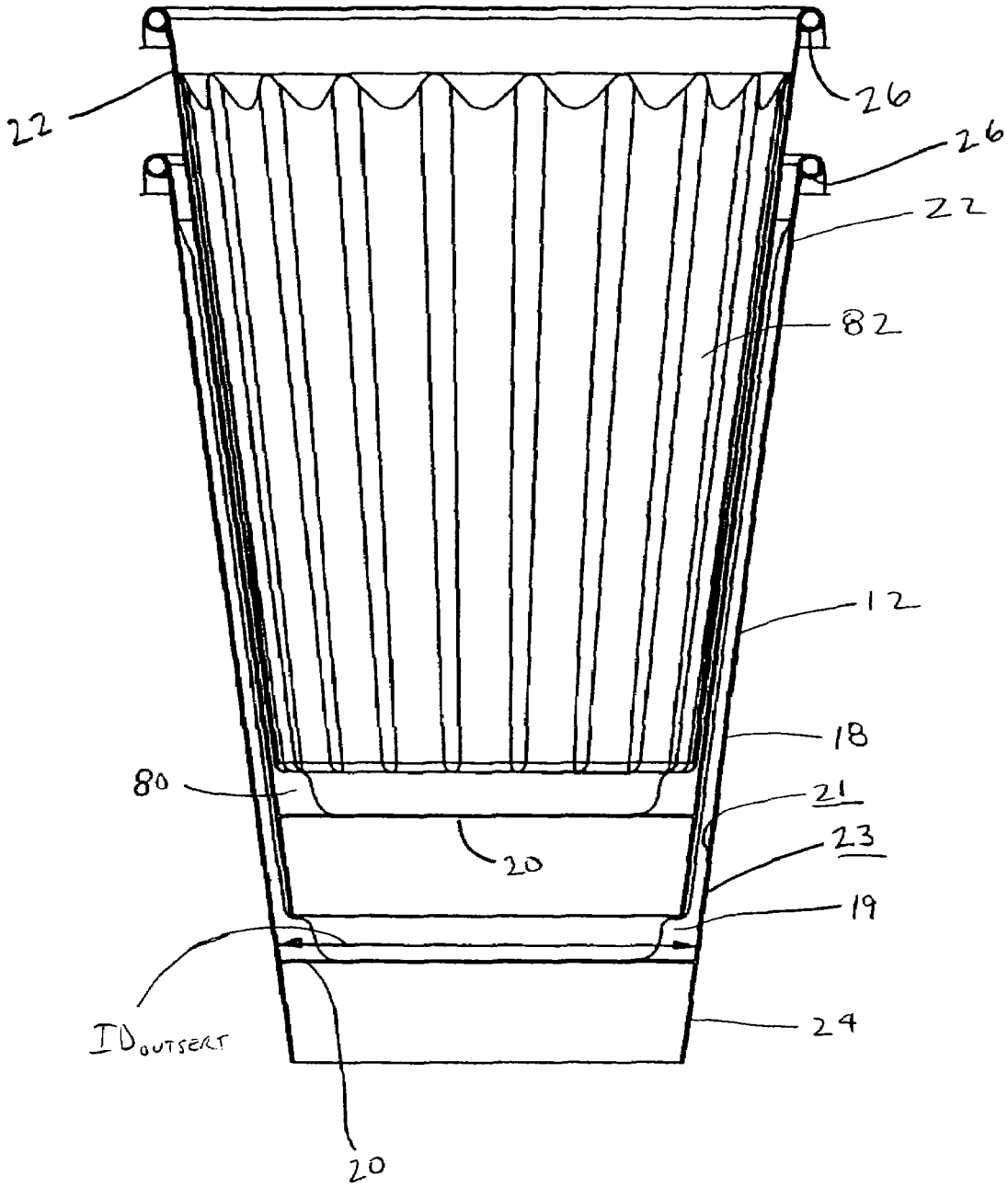
FIG. 6 is a partial cross-sectional front elevation view of two partially-formed and nested insulated containers of FIG. 5.

Delete Figs 5 and 6 substitute Figs 5 and 6 below therefor

Figure 7:
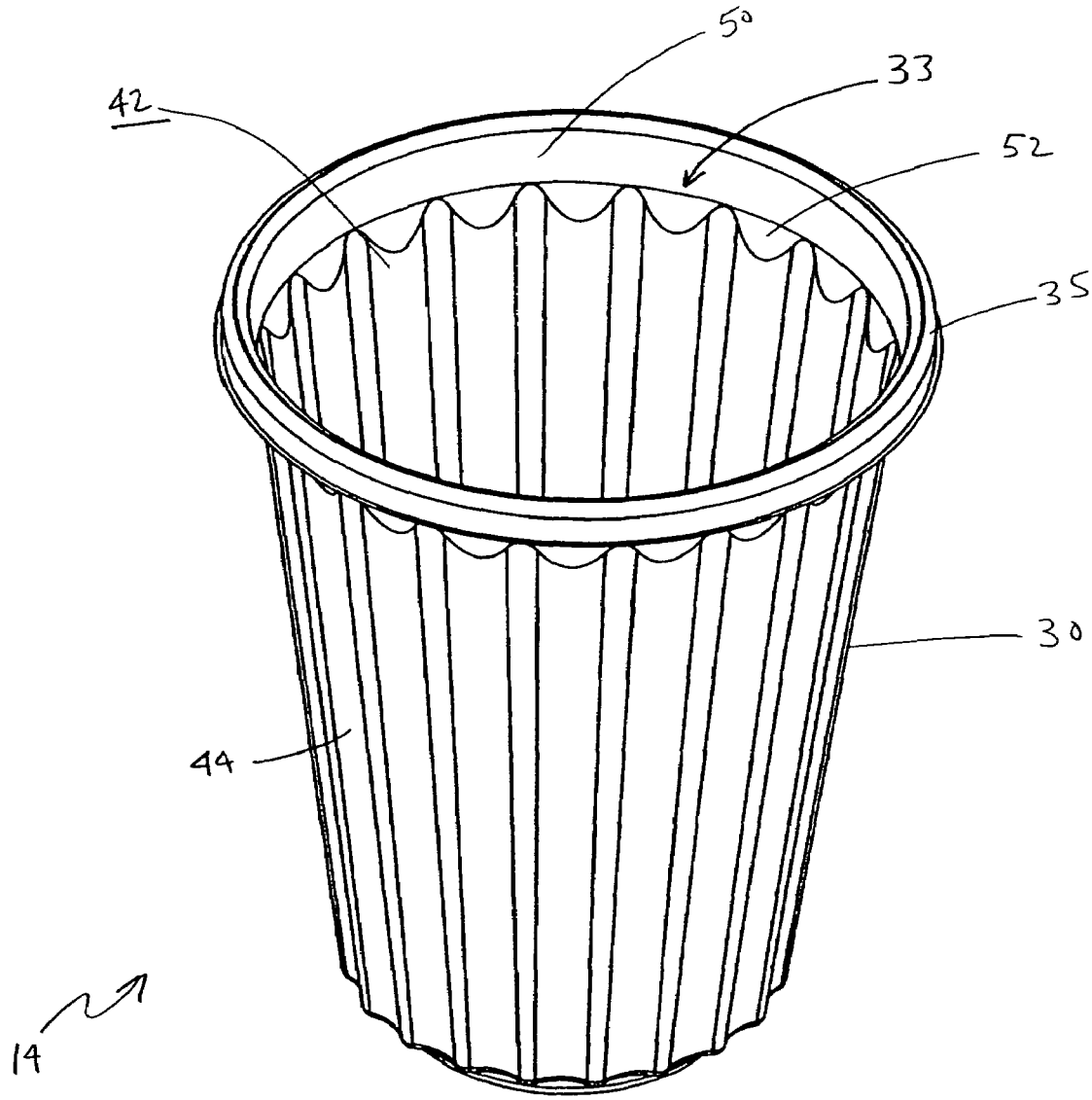
FIG. 7 is a perspective view of one embodiment of an insert for the container.
Figure 8:
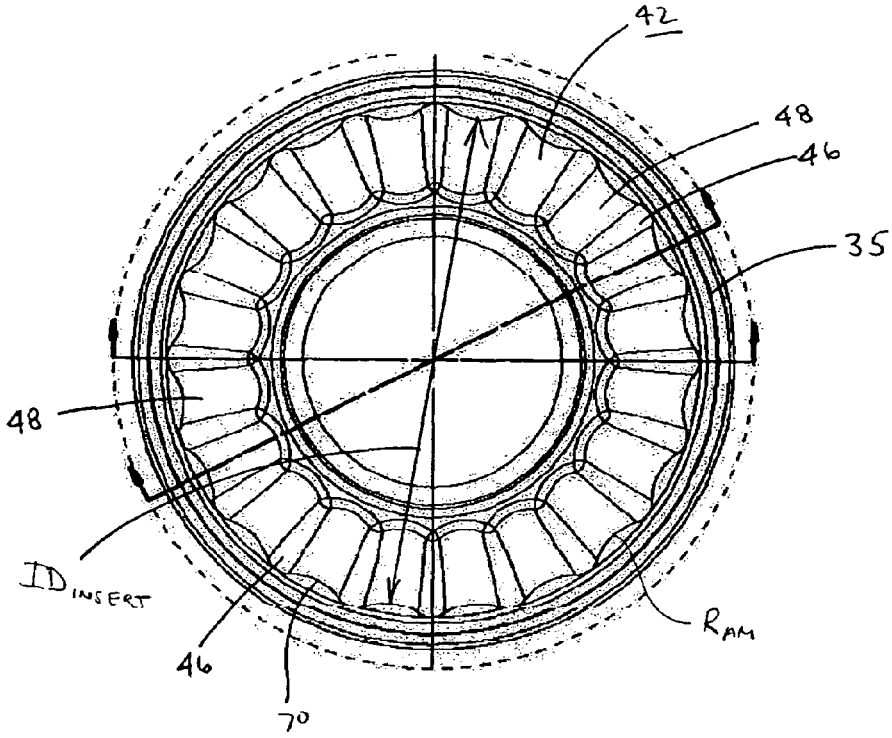
FIG. 8 is a top plan view of the insert of FIG. 7.

Delete Figs 7 and 8 substitute Figs 7 and 8 below therefor

Delete Figs 9 and 10 substitute Figs 9 and 10 below therefor

Delete Figs 11 and 12 substitute Figs 11 and 12 below therefor

Figure 14:
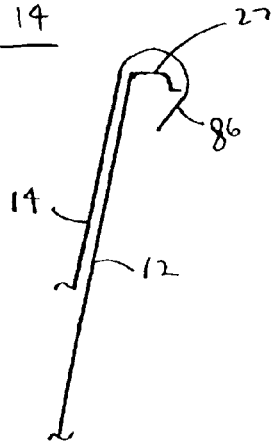
FIG. 14 is a partial cross-sectional view of another embodiment of the rim region of the container.

Delete Figs 13 and 14 substitute Figs 13 and 14 below therefor

Delete Figs 15-18 substitute Figs 15-18 below therefor

Delete Figs 19A, 19B substitute Figs 19A, 19B below therefor

Figure 20:
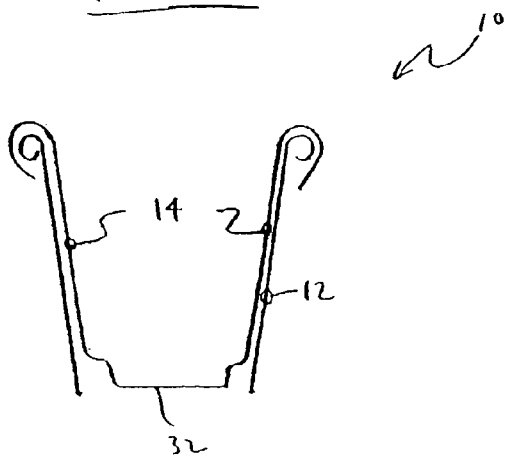
FIG. 20 is a front cross-sectional view of another embodiment of an insulated container.

Delete Figs 20 and 21 substitute Figs 20 and 21 below therefor

Delete Fig 22 substitute Fig 22 below therefor

(12) United States Patent
Smith et al.

(10) Patent No.: US 7,699,216 B2
(45) Date of Patent: Apr. 20, 2010

(54) TWO-PIECE INSULATED CUP

(75) Inventors: Stephen Alan Smith, Naperville, IL (US); Warren Giles Wiedmeyer, Trevor, WI (US); Ayberk Abayhan, Lake Bluff, IL (US); Anthony Joseph Kreml, Jr., Baltimore, MD (US); Alvin Chester Hartman, Baltimore, MD (US); Semyon Bekker, Baltimore, MD (US); Greg Neal, Pasadena, MD (US); Robert Joseph Schaefer, Nottingham, MD (US); Robert Michael Scheele, Rogersville, MO (US); Dennis Wayne Martin, Springfield, MO (US)

(73) Assignee: Solo Cup Operating Corporation, Lake Forest, IL (US)

(*) Notice: Subject to any disclaimer, the term of this patent is extended or adjusted under 35 U.S.C. 154(b) by 1467 days.

(21) Appl. No.: 10/982,187

(22) Filed: Nov. 4, 2004

(65) Prior Publication Data

US 2005/0115975 A1 Jun. 2, 2005

Related U.S. Application Data

(60) Provisional application No. 60/525,531, filed on Nov. 26, 2003, provisional application No. 60/591,644, filed on Jul. 28, 2004.

(51) Int. Cl.
*B65D 3/22* (2006.01)
*B65D 21/04* (2006.01)

(52) U.S. Cl. ..... 229/403; 206/515; 206/519; 229/103.11

(58) Field of Classification Search ..... 229/103.11, 229/403; 206/515, 519, 520; 220/592.17, 220/592.2, 737, 738, 739
See application file for complete search history.

(56) References Cited

U.S. PATENT DOCUMENTS

| | | | |
|---|---|---|---|
| 809,812 | A | 1/1906 | Kimsey |
| 811,409 | A | 1/1906 | Kimsey |
| 1,057,426 | A | 4/1913 | Heyl |
| 1,107,956 | A | 8/1914 | Jennings |
| 1,198,596 | A | 9/1916 | Strange |

(Continued)

FOREIGN PATENT DOCUMENTS

| | | |
|---|---|---|
| EP | 0 371 918 | 6/1990 |

(Continued)

OTHER PUBLICATIONS

Huhtamaki reference regarding thermoforming, dated at least as early as Nov. 2004.

(Continued)

*Primary Examiner*—Gary E Elkins
(74) *Attorney, Agent, or Firm* – Banner & Witcoff, Ltd.

(57) ABSTRACT

The present invention generally provides an insulating vessel for beverages. The vessel has an outsert and a insert. The insert is positioned within the cavity of the outsert. In one embodiment the insert has a plurality of insulating members that are spaced from an inner surface of the outsert to define a series of air gaps between an outer surface of the insulating members and the inner surface of the outsert. In another embodiment, the insert and outsert have generally conical side walls with substantially the same taper angle so as to be in a friction lock relationship with one another.

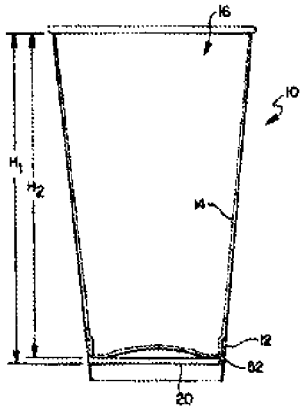

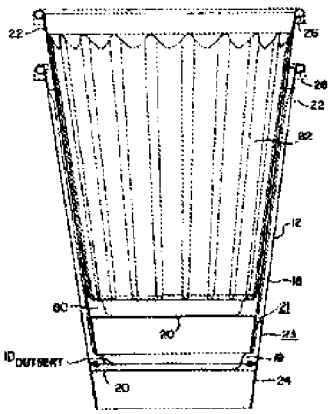

44 Claims, 10 Drawing Sheets